US009851132B2

(12) United States Patent
Kawano et al.

(10) Patent No.: US 9,851,132 B2
(45) Date of Patent: Dec. 26, 2017

(54) AIR CONDITIONER

(71) Applicant: DAIKIN INDUSTRIES, LTD., Osaka-shi, Osaka (JP)

(72) Inventors: Satoshi Kawano, Oostende (BE); Shinya Matsuoka, Osaka (JP); Masahiro Oka, Osaka (JP); Mari Susaki, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 288 days.

(21) Appl. No.: 14/649,098

(22) PCT Filed: Nov. 29, 2013

(86) PCT No.: PCT/JP2013/007039
§ 371 (c)(1),
(2) Date: Jun. 2, 2015

(87) PCT Pub. No.: WO2014/103172
PCT Pub. Date: Jul. 3, 2014

(65) Prior Publication Data

US 2015/0345842 A1 Dec. 3, 2015

(30) Foreign Application Priority Data

Dec. 28, 2012 (JP) ..... 2012-288280

(51) Int. Cl.
*F25B 41/04* (2006.01)
*F25B 13/00* (2006.01)
*F24F 3/08* (2006.01)

(52) U.S. Cl.
CPC ..... *F25B 41/04* (2013.01); *F24F 3/08* (2013.01); *F25B 13/00* (2013.01);
(Continued)

(58) Field of Classification Search
CPC .... F25B 3/08; F25B 13/00; F25B 2313/0231; F25B 2313/0233; F25B 2313/0272;
(Continued)

(56) References Cited

U.S. PATENT DOCUMENTS 8,091,377 B2 * 1/2012 Jeong ..... F25B 13/00 62/159
2003/0230105 A1 12/2003 Lee
(Continued)

FOREIGN PATENT DOCUMENTS

CN 1469084 A 1/2004
EP 0 514 086 A2 11/1992
(Continued)

OTHER PUBLICATIONS

International Search Report issued in PCT/JP2013/007039 dated Feb. 10, 2014.

*Primary Examiner* — Marc Norman
(74) *Attorney, Agent, or Firm* — Birch, Stewart, Kolasch & Birch, LLP

(57) ABSTRACT

This air conditioner performs a cooling operation and a heating operation in parallel with each other with an outdoor unit and indoor units connected together through two communication pipes. The air conditioner includes a switching mechanism changing the directions of refrigerants flowing through the communication pipes depending on whether a heating dominant operation is being performed in a first load region where a cooling load is relatively light or a second load region where the cooling load is heavier than in the first load region. In the second load region, the switching mechanism allows a low-pressure refrigerant to flow from the indoor units to the outdoor unit through the second communication pipe thicker than the first communication pipe to
(Continued)

reduce a performance deterioration due to the pressure loss involved with the heating dominant operation.

20 Claims, 11 Drawing Sheets

(52) U.S. Cl.
CPC ..... *F25B 2313/0231* (2013.01); *F25B 2313/0233* (2013.01); *F25B 2313/0272* (2013.01); *F25B 2313/02731* (2013.01); *F25B 2313/02791* (2013.01); *F25B 2400/23* (2013.01); *F25B 2500/01* (2013.01)

(58) Field of Classification Search
CPC .. F25B 2313/02731; F25B 2313/02791; F25B 2400/23; F25B 2500/01; F24F 3/08
See application file for complete search history.

(56) References Cited

U.S. PATENT DOCUMENTS

| | | | | |
|---|---|---|---|---|
| 2003/0230107 | A1* | 12/2003 | Lee | F25B 13/00 62/324.6 |
| 2011/0023512 | A1* | 2/2011 | Kawagoe | F25B 13/00 62/196.1 |
| 2015/0300666 | A1* | 10/2015 | Kawano | F24F 5/001 62/324.1 |

FOREIGN PATENT DOCUMENTS

| | | | |
|---|---|---|---|
| EP | 1 371 921 | A1 | 12/2003 |
| JP | 2010-261713 | A | 11/2010 |

* cited by examiner

AIR CONDITIONER

TECHNICAL FIELD

The present invention relates to an air conditioner including a plurality of indoor heat exchangers, and more particularly relates to an air conditioner configured to perform a cooling operation and a heating operation in parallel with each other.

BACKGROUND ART

A so-called "cooling/heating free type air conditioner," which is an indoor-multi-type air conditioner including a plurality of indoor units and which is configured to be able to perform a cooling operation and a heating operation in parallel with each other, has been known (see, e.g., Patent Document 1). The air conditioner of Patent Document 1 includes a cooling/heating switching unit between an outdoor unit having an outdoor heat exchanger and indoor units each having an indoor heat exchanger. The outdoor unit is connected with the cooling/heating switching unit through two communication pipes. The cooling/heating switching unit is also connected with each of the indoor units through two other communication pipes.

In the air conditioner of Patent Document 1, the outdoor unit also includes a bridge circuit that defines the refrigerant flow directions to be constant in the communication pipes between the outdoor unit and the cooling/heating switching unit. On the other hand, changing the directions of the refrigerant flowing through the communication pipes between the cooling/heating switching unit and each indoor unit allows the indoor unit to selectively perform a cooling operation or a heating operation.

In the air conditioner of Patent Document 1, the communication pipes between the outdoor unit and the cooling/heating switching unit are comprised of a first communication pipe having a relatively small inside diameter and a second communication pipe having a larger inside diameter than the first one. During a cooling dominant operation in which a cooling load is heavier than a heating load, a high-pressure two-phase refrigerant or a high-pressure liquid refrigerant flows toward the indoor unit through the first communication pipe having the smaller inside diameter, whereas a low-pressure gas refrigerant flows toward the outdoor unit through the second communication pipe having the larger inside diameter. During a heating dominant operation where a heating load is heavier than a cooling load, a high-pressure gas refrigerant flows toward the indoor unit through the first communication pipe having the smaller inside diameter, whereas a low-pressure refrigerant flows toward the outdoor unit through the second communication pipe having the larger inside diameter.

CITATION LIST

Patent Document

PATENT DOCUMENT 1: Japanese Unexamined Patent Publication No. 2010-261713

SUMMARY OF THE INVENTION

Technical Problem

During the heating dominant operation, particularly on a condition that the heating load is full or significantly large, the refrigerant returning from each indoor unit to the outdoor unit is a liquid-rich refrigerant, which will cause a little pressure loss when passing through the first communication pipe having the smaller inside diameter. As a result, a refrigeration cycle is performed under a proper condition.

However, during the heating dominant operation, particularly on a condition that the heating load is relatively light and the cooling load is relatively heavy, the refrigerant returning from the indoor unit to the outdoor unit becomes a gas-rich refrigerant, which will cause much pressure loss when passing through the thinner first communication pipe. Consequently, the performance of the air conditioner deteriorates.

In view of the foregoing background, it is therefore an object of the present invention to prevent an air conditioner, including an outdoor unit connected with indoor units through two communication pipes to perform a cooling operation and a heating operation in parallel with each other, from causing a deterioration in its performance due to such pressure loss during the heating dominant operation.

Solution to the Problem

A first aspect of the present invention is directed to an air conditioner including a refrigerant circuit (20) in which an outdoor unit (2) and a plurality of indoor units (3) are connected together through communication pipes (11, 12, 13, 14) and which is configured to be able to perform a refrigeration cycle in which cooling and heating operations are performed in parallel with each other. The communication pipes (11, 12, 13, 14) include a first communication pipe (11) and a second communication pipe (12) which has a larger inside diameter than the first communication pipe (11).

This air conditioner includes a switching mechanism (23) which changes the directions of refrigerants flowing through the first and second communication pipes (11, 12) depending on whether a heating dominant operation to be conducted between a full-heating load operation and a balanced heating and cooling load operation is being performed in a first load region which ranges from a full-heating load to a partial-cooling load or a second load region which ranges from the partial-cooling load to balanced heating and cooling loads. In the first load region, the switching mechanism (23) allows a high-pressure refrigerant to flow from the outdoor unit (2) to the indoor units (3) through the second communication pipe (12), and allows a low-pressure refrigerant to flow from the indoor units (3) to the outdoor unit (2) through the first communication pipe (11). In the second load region, the switching mechanism (23) allows the high-pressure refrigerant to flow from the outdoor unit (2) to the indoor units (3) through the first communication pipe (11), and allows the low-pressure refrigerant to flow from the indoor units (3) to the outdoor unit (2) through the second communication pipe (12).

According to the first aspect of the present invention, in a first load region where the heating load is heavy, a high-pressure refrigerant (more particularly, a high-pressure gas refrigerant) flows from an outdoor unit (2) to indoor units (3) through a second communication pipe (12) having a larger inside diameter, and a low-pressure refrigerant (more particularly, a low-pressure two-phase refrigerant or a low-pressure liquid refrigerant) flows from the indoor units (3) to the outdoor unit (2) through a first communication pipe having a smaller inside diameter (11). On the other hand, in a second load region where the cooling load is relatively heavy, a high-pressure refrigerant (more particularly, a high-pressure gas refrigerant) flows from the outdoor unit (2) to the indoor units (3) through the first communication pipe (11), and a low-pressure refrigerant (more particularly, a low-pressure two-phase refrigerant) flows from the indoor units (3) to the outdoor unit (2) through the second communication pipe (12). The refrigerant returning from the indoor units (3) to the outdoor unit (2) in the second load region is more gas-rich than that in the first load region. However, this refrigerant passes through the thicker second communication pipe (12), and thus causes smaller pressure loss.

A second aspect of the present invention is an embodiment of the first aspect of the present invention. In the second aspect, in all the regions of the heating dominant operation, the switching mechanism (23) is configured to perform a refrigeration cycle in which an outdoor heat exchanger (22) in the outdoor unit (2) serves as an evaporator.

According to the second aspect of the present invention, the directions of refrigerants flowing through the first and second communication pipes (11, 12) can be changed depending on whether the current mode of operation is in the first load region or in the second load region on an operation condition that the heating load is heavier than the cooling load so that the outdoor heat exchanger (22) serves as an evaporator.

A third aspect of the present invention is an embodiment of the second aspect of the present invention. In the third aspect, the outdoor unit (2) includes a compressor (21) compressing the refrigerant, the outdoor heat exchanger (22) exchanging heat between the refrigerant and outdoor air, and the switching mechanism (23). The switching mechanism (23) includes a pipe switching section (25) that is able to make a switch between a first position and a second position. The pipe switching section (25) in the first position allows the high-pressure refrigerant discharged from the compressor (21) in the first load region to enter the second communication pipe (12), and allows the low-pressure refrigerant returning from the indoor units (3) to the outdoor unit (2) through the first communication pipe (11) to enter the outdoor heat exchanger (22). The pipe switching section (25) in the second position allows the high-pressure refrigerant discharged from the compressor (21) in the second load region to enter the first communication pipe (11), and allows the low-pressure refrigerant returning from the indoor units (3) to the outdoor unit (2) through the second communication pipe (12) to enter the outdoor heat exchanger (22).

According to the third aspect of the present invention, the pipe switching section (25) set to be the second position allows the low-pressure refrigerant to return from the indoor units (3) to the outdoor unit (2) through the second communication pipe (12).

A fourth aspect of the present invention is an embodiment of the third aspect of the present invention. In the fourth aspect, the switching mechanism (23) includes an operation mode switching section (24) that is able to make a switch between a first position where the heating dominant operation is conducted and a second position where the cooling dominant operation is conducted. The operation mode switching section (24) in the first position allows the high-pressure refrigerant discharged from the compressor (21) to enter the first communication pipe (11) or the second communication pipe (12) through the pipe switching section (25), and also allows the low-pressure refrigerant evaporated in the outdoor heat exchanger (22) to enter the compressor (21). The operation mode switching section (24) in the second position allows the high-pressure refrigerant discharged from the compressor (21) to enter the first communication pipe (11) through the outdoor heat exchanger (22) and the pipe switching section (25), and also allows the refrigerant returning to the outdoor unit (2) through the second communication pipe (12) to enter the compressor (21).

According to the fourth aspect of the present invention, the operation mode switching section (24) set to be the first position and the pipe switching section (25) set to be the second position allow the low-pressure refrigerant to return from the indoor units (3) to the outdoor unit (2) through the second communication pipe (12).

A fifth aspect of the present invention is an embodiment of the third or fourth aspect of the present invention. In the fifth aspect, the pipe switching section (25) includes four connection points (P11, P12, P13, P14) and four passages (31, 32, 33, 34). The pipe switching section (25) is implemented as a switching circuit (25) in which the first and second connection points (P11, P12) are connected together through the first passage (31), the second and third connection points (P12, P13) are connected together through the second passage (32), the third and fourth connection points (P13, P14) are connected together through the third passage (33), the fourth and first connection points (P14, P11) are connected together through the fourth passage (34), and the passages (31, 32, 33, 34) of the switching circuit (25) include opening/closing mechanisms (35, 36, 37, 38), respectively.

According to the fifth aspect of the present invention, the state of the refrigerant flowing through the pipe switching section (25) can be set by switching the opened and closed states of the opening/closing mechanisms (35, 36, 37, 38).

A sixth aspect of the present invention is an embodiment of the fifth aspect of the present invention. In the sixth aspect, the operation mode switching section (24) is a switching valve that switches communication states of a discharge-side pipe (26) and a suction-side pipe (27) of the compressor (21) to allow one of the discharge-side pipe (26) and the suction-side pipe (27) to communicate with a gas-side end of the outdoor heat exchanger (22). The first connection point (P11) of the pipe switching section (25) is pipe-connected to the discharge-side pipe (26) of the compressor (21). The second connection point (P12) is pipe-connected to the first communication pipe (11). The third connection point (P13) is pipe-connected to a liquid-side end of the outdoor heat exchanger (22). The fourth connection point (P14) is connected to the second communication pipe (12) through a branch pipe (28*a*) and also connected to the suction-side pipe (27) of the compressor (21) through a branch pipe (28*b*). An on-off valve (29) is provided for the branch pipe (28*b*) between the fourth connection point (P14) and the suction-side pipe (27) of the compressor (21).

According to the sixth aspect of the present invention, the switching valve (24) and the on-off valve (29) allow for setting the state of the refrigerant flowing through the pipe switching section (25).

A seventh aspect of the present invention is an embodiment of any one of the first to sixth aspects of the present invention. In the seventh aspect, the air conditioner includes a gas-liquid separation unit (4) including a gas-liquid separator (41) separating a refrigerant including liquid into a gas phase and a liquid phase, and connected between the outdoor unit (2) and each of the indoor units (3); and operation switching units (5), each of which is connected between the gas-liquid separation unit (4) and a corresponding one of the indoor units (3), and including switching valves (63, 64)

switching flows of a liquid refrigerant and a gas refrigerant in the corresponding indoor unit (3).

According to the seventh aspect of the present invention, in an air conditioner in which a gas-liquid separation unit (4) and operation switching units (5) are arranged between the outdoor unit (2) and the indoor units (3), a refrigerant returning from the indoor units (3) to the outdoor unit (2) passes through the thicker second communication pipe (12) in the second load region. This reduces the pressure loss.

An eighth aspect of the present invention is an embodiment of the seventh aspect of the present invention. In the eighth aspect, the gas-liquid separation unit (4) and the operation switching unit (5) are integrated together to form a single cooling/heating switching unit (6) including the gas-liquid separator (41) and the switching valves (63, 64).

According to the eighth aspect of the present invention, in an air conditioner in which a cooling/heating switching unit (6) including the gas-liquid separator (41) and the switching valves (63, 64) is arranged between the outdoor unit (2) and the indoor units (3), a refrigerant returning from the indoor units (3) to the outdoor unit (2) passes through the thicker second communication pipe (12) in the second load region. This reduces the pressure loss.

A ninth aspect of the present invention is an embodiment of any one of the first to eighth aspects of the present invention. In the ninth aspect, the refrigerant in the refrigerant circuit (20) is difluoromethane.

According to the ninth aspect of the present invention, the influence of the pressure loss can be reduced when difluoromethane is used since the pressure in the refrigerant circuit (20) is set to relatively high pressure.

A tenth aspect of the present invention is directed to an air conditioner upgraded from an air conditioner, in which an outdoor unit (2) and a plurality of indoor units (3) are connected together through a first communication pipe (11) and a second communication pipe (12), having a larger inside diameter than the first communication pipe (11), to allow a refrigerant circuit filled with a previous refrigerant to perform a cooling/heating switchable refrigeration cycle, into an air conditioner including a refrigerant circuit (20) in which a new refrigerant, having a higher operating pressure than the previous refrigerant, is used to perform a refrigeration cycle in which cooling and heating operations are performed in parallel with each other.

At the time of upgrading the air conditioner, installed is a switching mechanism (23) which changes the directions of a refrigerant flowing through the first and second communication pipes (11, 12) depending on whether a heating dominant operation conducted between a full-heating load operation and a balanced heating and cooling load operation is being performed in a first load region ranging from a full-heating load to a partial-cooling load or a second load region ranging from the partial-cooling load to balanced heating and cooling loads. In the first load region, the switching mechanism (23) allows a high-pressure refrigerant to flow from the outdoor unit (2) to the indoor units (3) through the second communication pipe (12), and allows a low-pressure refrigerant to flow from the indoor units (3) to the outdoor unit (2) through the first communication pipe (11). In the second load region, the switching mechanism (23) allows a high-pressure refrigerant to flow from the outdoor unit (2) to the indoor units (3) through the first communication pipe (11), and allows a low-pressure refrigerant to flow from the indoor units (3) to the outdoor unit (2) through the second communication pipe (12).

An eleventh aspect of the present invention is an embodiment of the tenth aspect of the present invention. In the eleventh aspect, the refrigerant in the refrigerant circuit (20) of the upgraded air conditioner is difluoromethane.

According to the tenth and eleventh aspects of the present invention, in the upgraded air conditioner which uses a refrigerant such as difluoromethane with a high working pressure, a refrigerant returning from the indoor unit (3) to the outdoor unit (2) in the second load region is more gas-rich than that in the first load region. However, this refrigerant passes through the thicker second communication pipe (12), and thus would cause smaller pressure loss.

Advantages of the Invention

According to the present invention, a high-pressure refrigerant (more particularly, a high-pressure gas refrigerant) flows from the outdoor unit (2) to the indoor units (3) through the first communication pipe (11), and a low-pressure refrigerant (more particularly, a low-pressure two-phase refrigerant) flows from the indoor units (3) to the outdoor unit (2) through the second communication pipe (12) thicker than the first communication pipe (11), when the heating dominant operation is being performed in the second load region in which the cooling load is relatively heavy. This reduces the pressure loss of a refrigerant returning from the indoor units (3) to the outdoor unit (2) in the second load region, and thus, the deterioration in performance due to the pressure loss can be reduced during the heating dominant operation. In addition, a cooling/heating free air conditioner is provided by using two communication pipes, namely, the first communication pipe (11) and the second communication pipe (12) thicker than the first communication pipe (11). This facilitates the pipe connecting process at the time of reinstallation. Furthermore, the refrigerant circuit may also be formed using communication pipes having a relatively small diameter. This contributes to a reduction in material cost.

According to the second aspect of the present invention, at the time of making a switch between the cooling dominant operation and the heating dominant operation, the directions of the refrigerants flowing through the first and second communication pipes (11, 12) do not change. This reliably reduces the pressure loss to be caused by a refrigerant returning from the indoor units (3) to the outdoor unit (2) when the heating dominant operation is being performed in the second load region in which the cooling load is relatively heavy. As a result, a deterioration in the performance of the air conditioner can be reduced just as intended.

According to the third and fourth aspects of the present invention, the pipe switching section (25) allows a low-pressure refrigerant returning from the indoor units (3) to the outdoor unit (2) in the second load region to pass through the second communication pipe (12). This reliably reduces the deterioration in performance due to the pressure loss caused by the refrigerant.

According to the fifth aspect of the present invention, the pipe switching section (25) is implemented as a switching circuit, which simplifies the configuration.

According to the sixth aspect of the present invention, the operation mode switching section (24) is implemented as a switching valve, which also simplifies the configuration.

According to the seventh aspect of the present invention, an air conditioner in which a gas-liquid separation unit (4) and an operation switching unit (5) are arranged between the outdoor unit (2) and the indoor units (3) can avoid a performance deterioration due to the pressure loss during the heating dominant operation.

According to the eighth aspect of the present invention, a single cooling/heating switching unit (6) including a gas-liquid separator (41) and switching valves (63, 64) is arranged between the outdoor unit (2) and the indoor units (3), thus facilitating the process of connecting the outdoor unit (2) with the respective indoor units (3). This can also reduce the performance deterioration due to the pressure loss during the heating dominant operation.

Here, difluoromethane contributes more effectively to refrigeration than R22, R407C, or R410A does. Thus, to achieve the same performance level, the amount of difluoromethane to circulate may be smaller than that of R22 or any other refrigerant to circulate. Thus, the pressure loss to be caused when difluoromethane flows through a channel having a certain diameter becomes smaller than the loss to be caused when a refrigerant such as R22 flows through a channel having the same diameter. Consequently, according to the ninth aspect of the present invention, the refrigerant circuit (20) in which difluoromethane is used as a refrigerant is allowed to reduce even more effectively the performance deterioration of the air conditioner due to the pressure loss.

According to the tenth aspect of the present invention, a refrigerant having a higher working pressure than the previous refrigerant is used. Thus, the tolerance range of the pressure loss to be caused by the refrigerant broadens. In general, when a cooling/heating free type air conditioner is newly installed on site by using two communication pipes, namely, the first and second communication pipes (11, 12), a difference in diameter between the two pipes is usually set to be smaller than the difference in diameter between the two communication pipes, namely, the first and second communication pipes (11, 12) of a cooling/heating switchable air conditioner yet to be upgraded. However, in the present invention, a refrigerant of which the working pressure is higher than the previous refrigerant is used, and thus even a cooling/heating free type air conditioner can be upgraded into an air conditioner including two preinstalled communication pipes (11, 12), namely, the first communication pipe (11) and the second communication pipe (12) thicker than the first communication pipe (11).

According to the eleventh aspect of the present invention, a refrigerant having a high working pressure such as difluoromethane is used in the upgraded air conditioner. Thus, a refrigerating effect achieved by such an air conditioner is greater than that of an air conditioner using R22, R407C, or R410A, and to achieve the same level of performance, the amount of difluoromethane to circulate may be smaller than that of a refrigerant such as R22 to circulate. That is, difluoromethane used as a refrigerant further reduces the pressure loss to be caused by the refrigerant returning from the indoor units (3) to the outdoor unit (2) in the second load region. This effectively reduces the deterioration in performance due to the pressure loss during the heating dominant operation.

DESCRIPTION OF EMBODIMENTS

Embodiments of the present invention will now be described in detail below with reference to the drawings.

《First Embodiment of the Invention》

A first embodiment of the present invention will be described below.

This embodiment relates to a so-called "cooling/heating free type air conditioner" that includes a plurality of indoor units connected in parallel with a single outdoor unit to perform a cooling operation and a heating operation in parallel with each other. This air conditioner has a configuration which may be used suitably for upgrading a preinstalled indoor-multi-type air conditioner that performs either a cooling operation or a heating operation just selectively, not in parallel with each other, to a cooling/heating free type air conditioner. In the following description, the refrigerant circuit of the air conditioner yet to be upgraded is supposed to be filled with R410A or R22 as a previous refrigerant, and the refrigerant circuit of the upgraded air conditioner is supposed to be filled with R32 (difluoromethane) as a new refrigerant.

Figure 1:
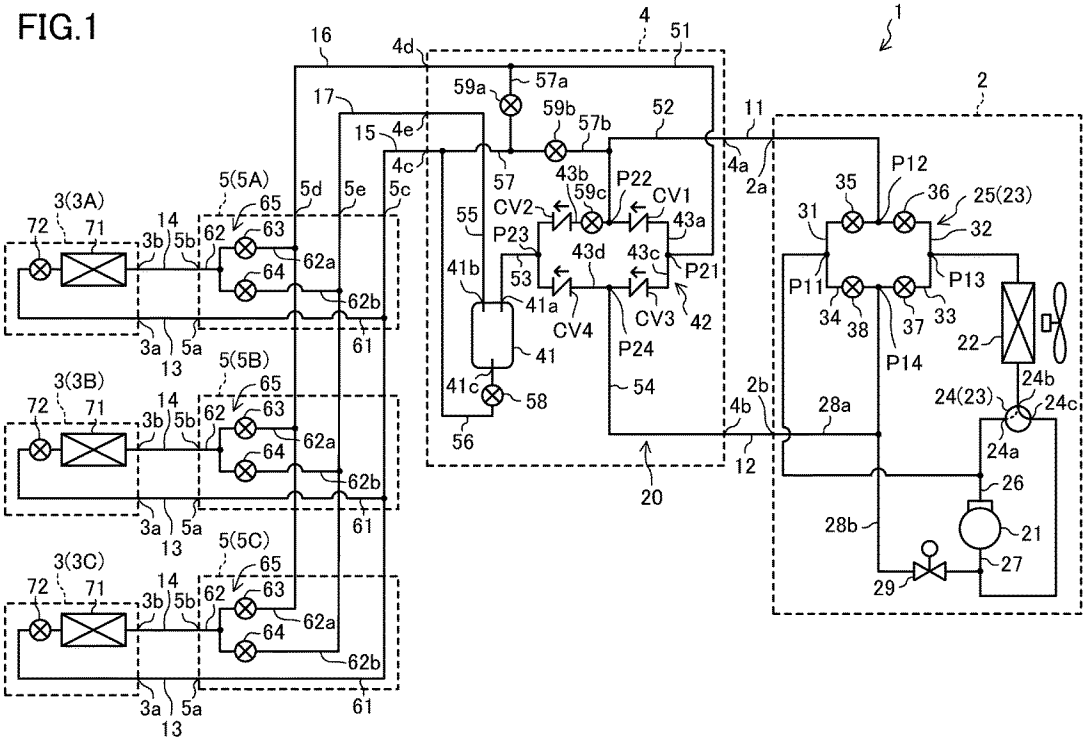
FIG. 1 illustrates a refrigerant circuit of an air conditioner according to a first embodiment of the present invention.

As illustrated in FIG. 1, this air conditioner (1) includes an outdoor unit (2), a plurality of (e.g., three in the example illustrated in FIG. 1) indoor units (3), a gas-liquid separation unit (4) including a gas-liquid separator, and as many operation switching units (5) as the indoor units (3). The gas-liquid separation unit (4) is provided separately from the operation switching units (5), and is connected to the outdoor unit (2) through two outdoor communication pipes (11, 12). Each of the operation switching units (5) is connected to an associated one of the indoor units (3) through two indoor communication pipes (13, 14). Also, each of the operation switching units (5) is connected in parallel to the gas-liquid separation unit (4) through three intermediate communication pipes (15, 16, 17). By connecting together the outdoor unit (2), the gas-liquid separation unit (4), the operation switching units (5), and the indoor units (3) in this manner, a refrigerant circuit (20) is formed which can perform a cooling/heating free type refrigeration cycle.

The outdoor communication pipes (11, 12) are comprised of a first outdoor communication pipe (11) and a second outdoor communication pipe (12). The indoor communication pipes (13, 14) are comprised of a first indoor communication pipe (13) and a second indoor communication pipe (14). The intermediate communication pipes (15, 16, 17) are comprised of a first intermediate communication pipe (15), a second intermediate communication pipe (16), and a third intermediate communication pipe (17). Regarding the outdoor communication pipes (11, 12), the indoor communication pipes (13, 14), and the intermediate communication pipes (15, 16, 17), their first communication pipes (11, 13, 15) have the same inside diameter. Their second communication pipes (12, 14, 16) have the same inside diameter, which is larger than the inside diameter of the first communication pipes. The third intermediate communication pipe (17) has the same inside diameter as the second intermediate communication pipe (16).

The outdoor unit (2) includes a compressor (21), an outdoor heat exchanger (a heat source-side heat exchanger) (22), and a switching mechanism (23). The compressor (21) compresses refrigerants. The outdoor heat exchanger (22) exchanges heat between the refrigerants and the outdoor air. The switching mechanism (23) changes the directions of the refrigerants flowing through the first and second outdoor communication pipes (11, 12). This outdoor unit (2) includes a first outdoor communication pipe port (2*a*) connected with the first outdoor communication pipe (11) and a second outdoor communication pipe port (2*b*) connected with the second outdoor communication pipe (12). The switching mechanism (23) includes a three-way valve (an operation mode switching section) (24) and a switching circuit (a pipe switching section) (25) comprised of four motor operated valves (35, 36, 37, 38) in combination.

The discharge-side pipe (26) of the compressor (21) is connected to a first port (24*a*) of the three-way valve (24). A second port (24*b*) of the three-way valve (24) is connected to a gas-side end of the outdoor heat exchanger (22). A third port (24*c*) of the three-way valve (24) is connected to the suction-side pipe (27) of the compressor (21). The liquid-side end of the outdoor heat exchanger (22) is connected to the switching circuit (25). The three-way valve (24) is a switching valve that switches communication states of the discharge-side pipe (26) and the suction-side pipe (27) to allow either the discharge-side pipe (26) or the suction-side pipe (27) of the compressor (21) to communicate with the gas-side end of the outdoor heat exchanger (22).

The switching circuit (25) includes four passages (31, 32, 33, 34), four connections (namely, a first connection point (P11), a second connection point (P12), a third connection point (P13), and a fourth connection point (P14)), and the four motor operated valves (opening/closing mechanisms) (35, 36, 37, 38). Each of the first, second, third and fourth connection points (P11, P12, P13, P14) connects their corresponding end portions of associated two of the four passages (31, 32, 33, 34). The four motor operated valves (35, 36, 37, 38) are provided for the passages (31, 32, 33, 34), respectively. In other words, the first, second, third and fourth outdoor motor operated valves (35, 36, 37, 38) are provided for the first, second, third and fourth passages (31, 32, 33, 34), respectively. More specifically, in the switching circuit (25), the first and second connection points (P11, P12) are connected together via the first passage (31), the second and third connection points (P12, P13) are connected together via the second passage (32), the third and fourth connection points (P13, P14) are connected together via the third passage (33), and the fourth and first connection points (P14, P11) are connected together via the fourth passage (34).

The first connection point (P11) of the switching circuit (25) is pipe-connected to the discharge-side pipe (26) of the compressor (21). The second connection point (P12) is pipe-connected to the first outdoor communication pipe (11). The third connection point (P13) is pipe-connected to the liquid-side end of the outdoor heat exchanger (22). The fourth connection point (P14) is connected to the second outdoor communication pipe (12) through a branch pipe (28*a*) and also connected to the suction-side pipe (27) of the compressor (21) through a branch pipe (28*b*). A solenoid valve (an on-off valve) (29) is provided for the branch pipe (28*b*) between the fourth connection point (P14) and the suction-side pipe (27) of the compressor (21).

The gas-liquid separation unit (4) includes a gas-liquid separator (41) and a refrigerant flow channel switching circuit (42) that switches flows of liquid refrigerants (or two-phase refrigerants) and gas refrigerants in the intermediate communication pipes (15, 16, 17) and the outdoor communication pipes (11, 12). The gas-liquid separation unit (4) also includes a first outdoor communication pipe port (4*a*) connected with the first outdoor communication pipe (11) and a second outdoor communication pipe port (4*b*) connected with the second outdoor communication pipe (12). The gas-liquid separation unit (4) includes a first intermediate communication pipe port (4*c*) connected with the first intermediate communication pipe (15), a second intermediate communication pipe port (4*d*) connected with the second intermediate communication pipe (16), and a third intermediate communication pipe port (4*e*) connected with the third intermediate communication pipe (17).

The refrigerant flow channel switching circuit (42) is a circuit including four passages (43*a*, 43*b*, 43*c*, 43*d*), four connections (namely, a first connection point (P21), a second connection point (P22), a third connection point (P23), and a fourth connection point (P24)), and four check valves (CV1, CV2, CV3, CV4). Each of the first, second, third and fourth connection points (P21, P22, P23, P24) connects their corresponding end portions of associated two of the four passages (43*a*, 43*b*, 43*c*, 43*d*). The four check valves (CV1, CV2, CV3, CV4) are provided for the passages (43*a*, 43*b*, 43*c*, 43*d*), respectively.

The first connection point (P21) of the refrigerant flow channel switching circuit (42) is connected to the second intermediate communication pipe port (4*d*) through a first connecting pipe (51). The second connection point (P22) of the refrigerant flow channel switching circuit (42) is connected to the first outdoor communication pipe port (4*a*) through a second connecting pipe (52). The third connection point (P23) of the refrigerant flow channel switching circuit (42) is connected to a refrigerant inlet (41*a*) of the gas-liquid separator (41) through a third connecting pipe (53). The fourth connection point (P24) of the refrigerant flow channel switching circuit (42) is connected to the second outdoor communication pipe port (4*b*) through a fourth connecting pipe (54).

The gas-liquid separator (41) has its gas refrigerant outlet (41*b*) connected to the third intermediate communication pipe port (4*e*) through a fifth connecting pipe (55). The gas-liquid separator (41) also has its liquid refrigerant outlet (41*c*) connected to the first intermediate communication pipe port (4*c*) through a sixth connecting pipe (56) having a first intermediate motor operated valve (58). The sixth connecting pipe (56) is connected with a seventh connecting pipe (57) at a point between the first intermediate motor operated valve (58) and the first intermediate communication pipe port (4*c*). The seventh connecting pipe (57) is branch piping comprised of a first branch pipe (57*a*) and a second branch pipe (57*b*). The first branch pipe (57*a*) is connected to the first connecting pipe (51). The second branch pipe (57*b*) is connected to the second connecting pipe (52). A second intermediate motor operated valve (59*a*) and a third intermediate motor operated valve (59*b*) are provided for the first branch pipe (57*a*) and the second branch pipe (57*b*), respectively.

The refrigerant flow channel switching circuit (42) includes first, second, third and fourth check valves (CV1, CV2, CV3, CV4) as the four check valves. The first check valve (CV1) allows the refrigerant to flow from the first connection point (P21) toward the second connection point (P22), but prohibits the refrigerant from flowing in reverse direction. The second check valve (CV2) allows the refrigerant to flow from the second connection point (P22) toward the third connection point (P23), but prohibits the refrigerant from flowing in reverse direction. The third check valve (CV3) allows the refrigerant to flow from the first connection point (P21) toward the fourth connection point (P24), but prohibits the refrigerant from flowing in reverse direction. The fourth check valve (CV4) allows the refrigerant to flow from the fourth connection point (P24) toward the third connection point (P23), but prohibits the refrigerant from flowing in reverse direction.

A fourth intermediate motor operated valve (59*c*) is also provided for the passage (43*b*) of the refrigerant flow channel switching circuit (42) at a point between the second connection point (P22) and the second check valve (CV2). The fourth intermediate motor operated valve (59*c*) is closed during the full-cooling operation to be described later (see FIG. 10) to prevent the refrigerant from flowing into the gas-liquid separator (41).

Each of the operation switching units (5) is connected to its associated indoor unit (3) through the two indoor communication pipes (13, 14). The operation switching units (5) each include a flow channel switching circuit (65) that switches the flow channels of a liquid refrigerant and a gas refrigerant between the intermediate communication pipes (15, 16, 17) and the indoor communication pipes (13, 14) in response to a switch made by the indoor unit (3) from a cooling operation into a heating operation and vice versa. The operation switching units (5) also each include a first indoor communication pipe port (5*a*) connected with the first indoor communication pipe (13), a second indoor communication pipe port (5*b*) connected with the second indoor communication pipe (14), a first intermediate communication pipe port (5*c*) connected with the first intermediate communication pipe (15), a second intermediate communication pipe port (5*d*) connected with the second intermediate communication pipe (16), and a third intermediate communication pipe port (5*e*) connected with the third intermediate communication pipe (17).

The operation switching units (5) each include a first communicating tube (61) and a second communicating tube (62). The first communicating tube (61) connects the first indoor communication pipe port (5*a*) with the first intermediate communication pipe port (5*c*). The second communicating tube (62) connects the second indoor communication pipe port (5*b*) with the second and third intermediate communication pipe ports (5*d*, 5*e*) in parallel with each other. The second communicating tube (62) is branch piping comprised of a first branch pipe (62*a*) connected to the second intermediate communication pipe port (5*d*) and a second branch pipe (62*b*) connected to the third intermediate communication pipe port (5*e*). A first switching valve (63) and a second switching valve (64) are also provided for the first and second branch pipes (62*a*, 62*b*), respectively. The first and second switching valves (63, 64) form the flow channel switching circuit (65).

The indoor units (3) each include an indoor heat exchanger (71) and an indoor expansion valve (72). The indoor units (3) each include a first indoor communication pipe port (3*a*) and a second indoor communication pipe port (3*b*). The indoor expansion valve (72) and the indoor heat exchanger (71) are connected in this order between the first and second indoor communication pipe ports (3*a*, 3*b*).

The first intermediate communication pipe port (5*c*) of the operation switching unit (5) is connected with the first intermediate communication pipe port (4*c*) of the gas-liquid separation unit (4) through the first intermediate communication pipe (15). The second intermediate communication pipe port (5*d*) of the operation switching unit (5) is connected with the second intermediate communication pipe port (4*d*) of the gas-liquid separation unit (4) through the second intermediate communication pipe (16). The third intermediate communication pipe port (5*e*) of the operation switching unit (5) is connected with the third intermediate communication pipe port (4*e*) of the gas-liquid separation unit (4) through the third intermediate communication pipe (17). The first intermediate communication pipe (15) forms part of a liquid-side communication pipe. The second and third intermediate communication pipes (16, 17) form parts of a gas-side communication pipe.

The first indoor communication pipe port (5*a*) of the operation switching unit (5) is connected with the first indoor communication pipe port (3*a*) of the indoor unit (3) through the first indoor communication pipe (13). The second indoor communication pipe port (5*b*) of the operation switching unit (5) is connected with the second indoor communication pipe port (3*b*) of the indoor unit (3) through the second indoor communication pipe (14). The first indoor communication pipe (13) forms part of the liquid-side communication pipe. The second indoor communication pipe (14) forms part of the gas-side communication pipe.

Next, the setting of the switching mechanism (23) will be described with reference to FIGS. 2A and 2B. In this embodiment, the switching mechanism (23) is configured to change the flow directions of a refrigerant according to the given load during a heating dominant operation where the heating load is heavier than the cooling load (see FIG. 2A). Specifically, the switching mechanism (23) is configured to change the directions of refrigerant flowing through the first and second outdoor communication pipes (11, 12) depending on whether the heating dominant operation to be performed between a full-heating load operation and a balanced heating and cooling load operation is performed in a first load region ranging from a full-heating load to a partial-cooling load (i.e., a region where the first heating dominant operation is conducted) or a second load region ranging from the partial-cooling load to balanced heating and cooling loads (i.e., a region where the second heating dominant operation is conducted).

Figure 2A:
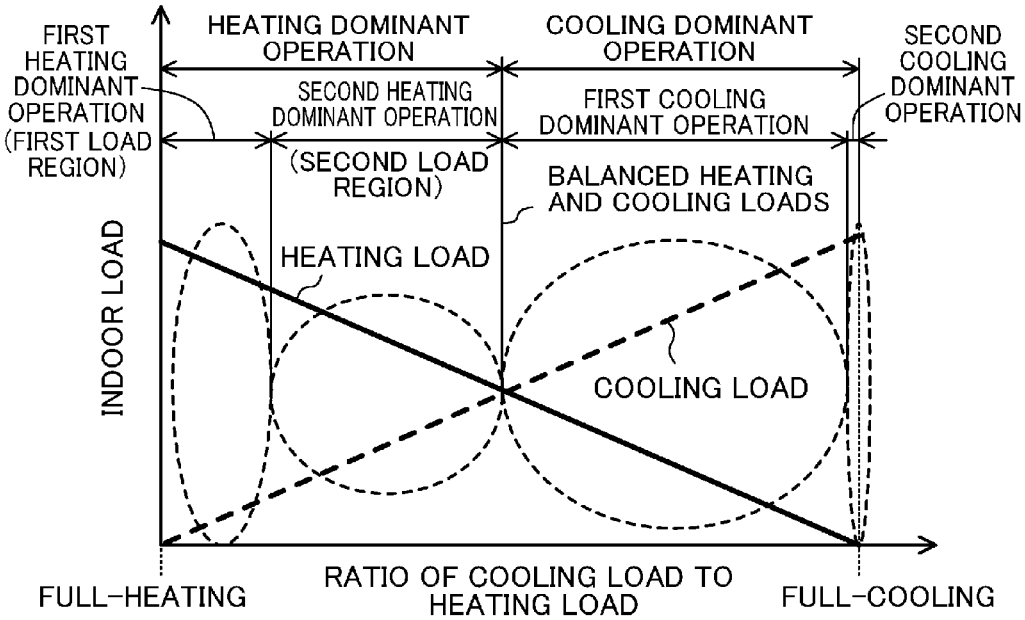
FIG. 2A is a graph showing four operation modes of the air conditioner by the ratio of a cooling load to a heating load.
Figure 2B:
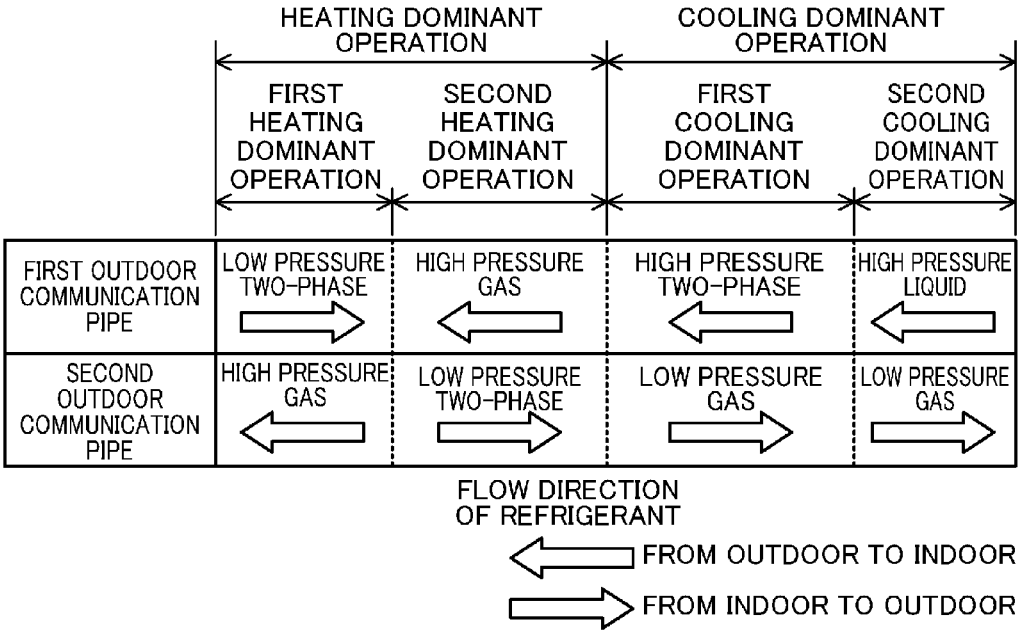
FIG. 2B is a table showing the flow directions of refrigerants on an operation mode basis.

As illustrated in FIG. 2B, in the first load region (i.e., the first heating dominant operation region), the switching mechanism (23) is configured to allow a high-pressure gas refrigerant to flow from the outdoor unit (2) to the indoor unit (3) through the second outdoor communication pipe (12), and also allow a low-pressure two-phase refrigerant to flow from the indoor unit (3) to the outdoor unit (2) through the first outdoor communication pipe (11). In the second load region (i.e., the second heating dominant operation region), the switching mechanism (23) is configured to allow a high-pressure gas refrigerant to flow from the outdoor unit (2) to the indoor unit (3) through the first outdoor communication pipe (11), and also allow a low-pressure two-phase refrigerant to flow from the indoor unit (3) to the outdoor unit (2) through the second outdoor communication pipe (12).

In all of those regions of the heating dominant operation including the first and second load regions, the switching mechanism (23) is also configured to perform a refrigeration cycle in the refrigerant circuit (20) such that the outdoor heat exchanger (22) in the outdoor unit (2) serves as an evaporator.

The switching mechanism (23) includes the pipe switching section (25) and the operation mode switching section (24). As described above, the pipe switching section (25) is also implemented as the switching circuit (25), and the operation mode switching section (24) is implemented as the three-way valve (24).

The switching circuit (25) is configured to be able to make a switch from a first position (see FIG. 6) to a second position (see FIG. 8), and vice versa. The switching circuit (25) in the first position allows a high-pressure refrigerant discharged from the compressor (21) in the first load region to enter the second outdoor communication pipe (12), and allows a low-pressure refrigerant returning from the indoor units (3) to the outdoor unit (2) through the first outdoor communication pipe (11) to enter the outdoor heat exchanger (22). The switching circuit (25) in the second position allows a high-pressure refrigerant discharged from the compressor (21) in the second load region to enter the first outdoor communication pipe (11), and allows a low-pressure refrigerant returning from the indoor units (3) to the outdoor unit (2) through the second outdoor communication pipe (12) to enter the outdoor heat exchanger (22).

When the switching circuit (25) is in the first position, the second and fourth outdoor motor operated valves (36, 38) are opened, and the first and third outdoor motor operated valves (35, 37) are closed. When the switching circuit (25) is in the second position, the first and third outdoor motor operated valves (35, 37) are opened, and the second and fourth outdoor motor operated valves (36, 38) are closed. During the cooling dominant operation, on the other hand, the opened/closed states of the respective motor operated valves (35, 36, 37, 38) are different from their states in the first or second position during the heating dominant operation. The opened/closed states of the respective motor operated valves (35, 36, 37, 38) in such a situation will be described later.

The three-way valve (24) is configured to be able to make a switch from a first position (see FIGS. 6 and 7) at which the heating dominant operation is conducted to a second position (see FIGS. 9 and 10) at which the cooling dominant operation is conducted, and vice versa. The three-way valve (24) in the first position allows a high-pressure refrigerant discharged from the compressor (21) to enter the first or second outdoor communication pipe (11, 12) through the switching circuit (25), and also allows a low-pressure refrigerant evaporated in the outdoor heat exchanger (22) to enter the compressor (21). The three-way valve (24) in the second position allows a high-pressure refrigerant discharged from the compressor (21) to enter the first outdoor communication pipe (11) through the outdoor heat exchanger (22) and the switching circuit (25), and also allows a refrigerant returning to the outdoor unit (2) through the second outdoor communication pipe (12) to enter the compressor (21). When the three-way valve (24) is in the first position, the first port (24*a*) is closed but the second and third ports (24*b*, 24*c*) communicate with each other. When the three-way valve (24) is in the second position, the first and second ports (24*a*, 24*b*) communicate with each other but the third port (24*c*) is closed.

—Method for Reinstalling the Air Conditioner (1)—

Next, a method for reinstalling this air conditioner (1) will be described.

The method for reinstalling the air conditioner (1) according to this embodiment is a reinstallation method for upgrading an air conditioner (1A) including a refrigerant circuit that is comprised of an outdoor unit (2) and a plurality of indoor units (3) to perform a cooling/heating switchable refrigeration cycle to an air conditioner (1B) including a refrigerant circuit that can perform a refrigeration cycle in which a cooling operation and a heating operation are performed in parallel with each other.

Figure 3:
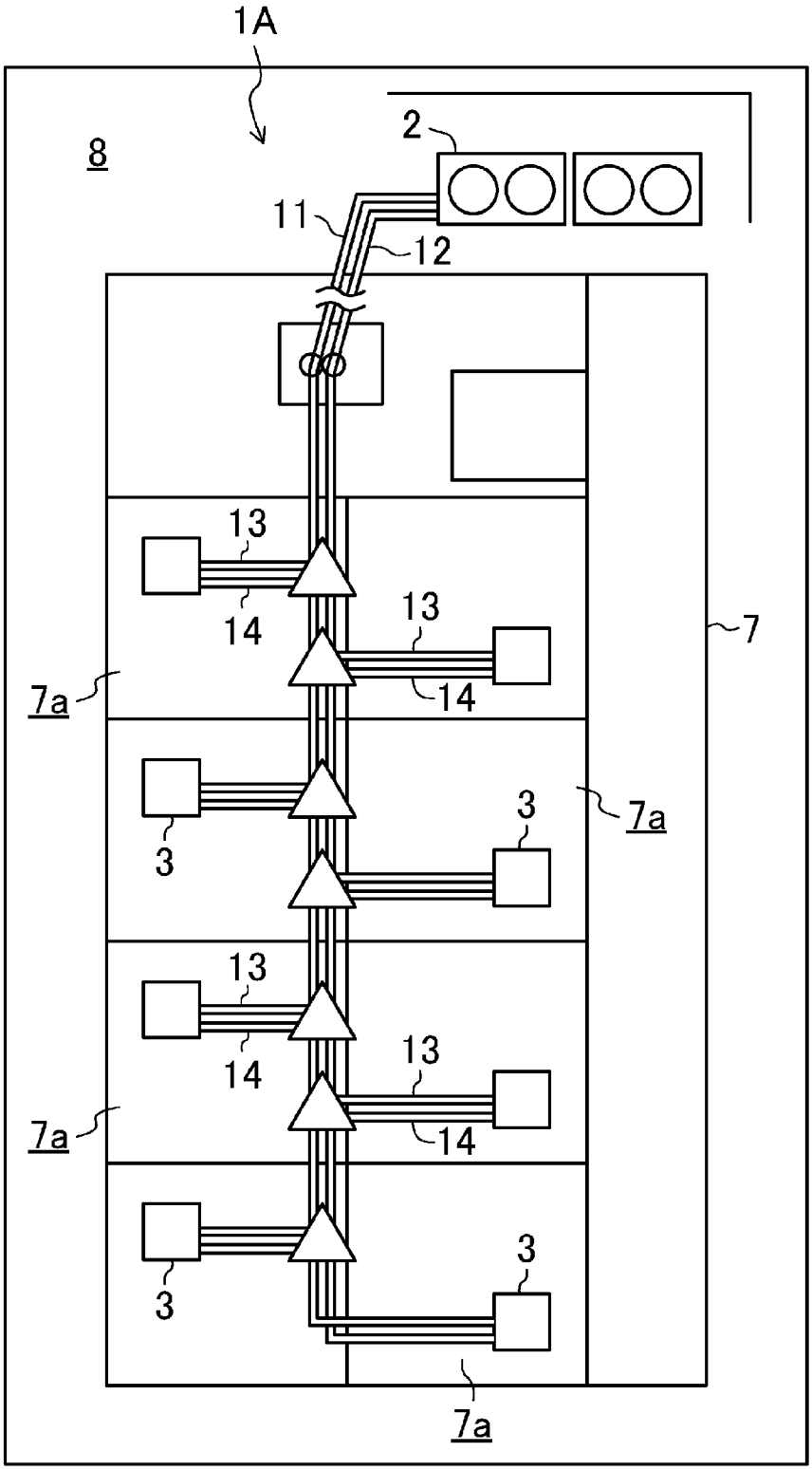
FIG. 3 illustrates a general configuration for an indoor-multi-type air conditioner in which multiple indoor units are connected in parallel with a single outdoor unit to make a switch from cooling to heating, and vice versa.
Figure 4:
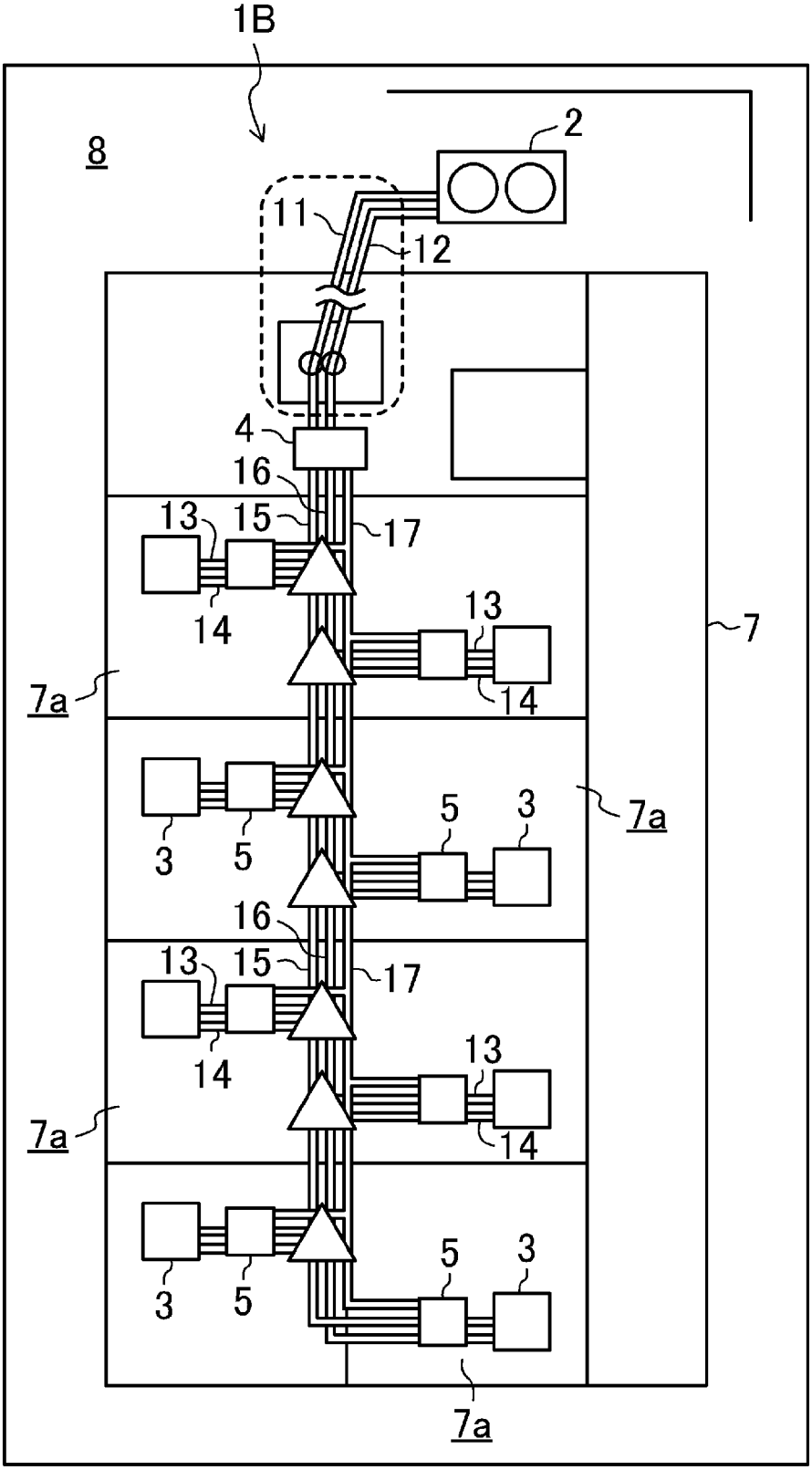
FIG. 4 illustrates a general configuration for an air conditioner according to an embodiment that can perform a cooling operation and a heating operation in parallel with each other.
Figure 5:
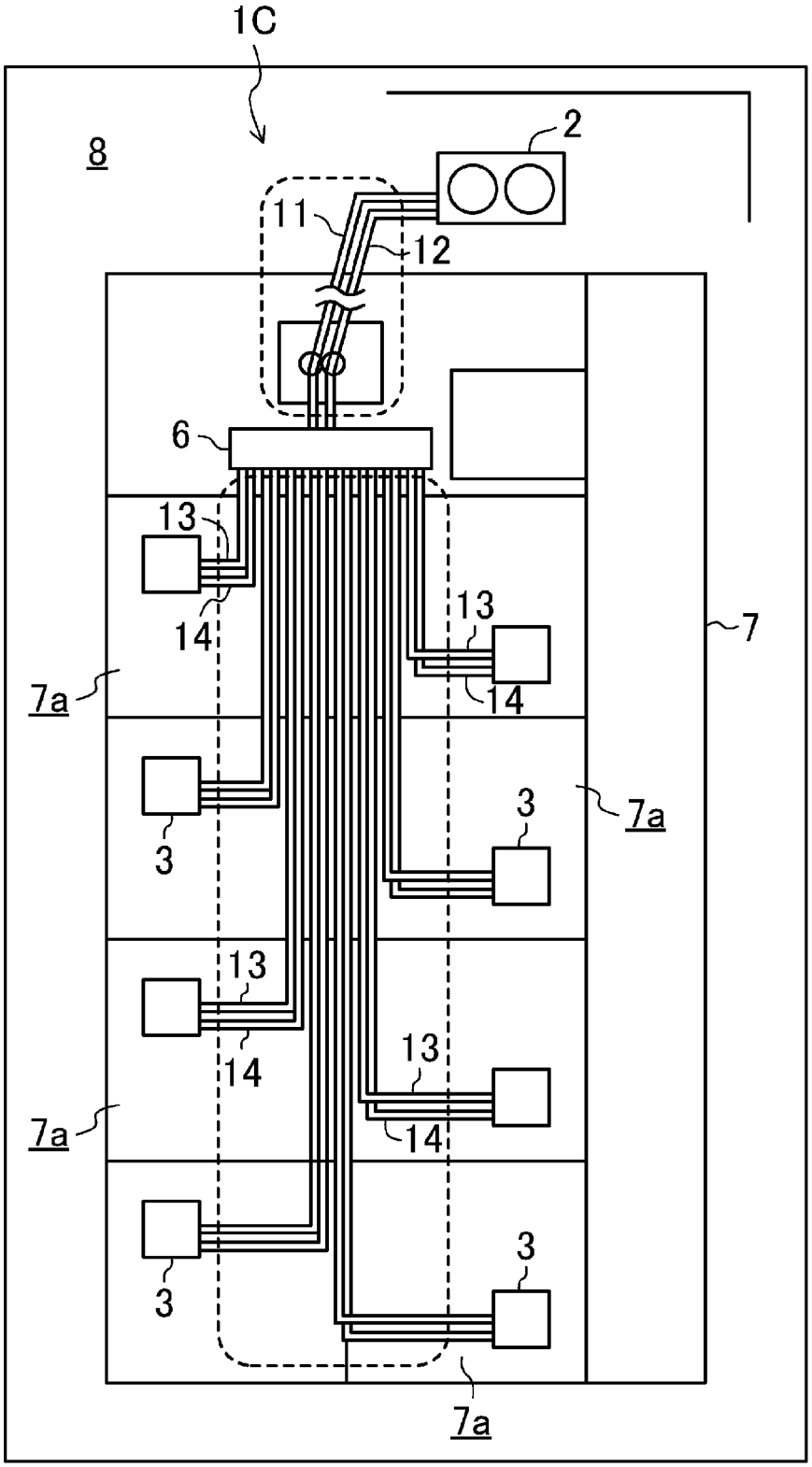
FIG. 5 illustrates a general configuration for a typical conventional cooling/heating free type air conditioner (as a comparative example).

FIG. 3 illustrates the preinstalled indoor-multi-type air conditioner (1A) (yet to be upgraded) including an outdoor unit (2) and a plurality of indoor units (3). The indoor units (3) are connected in parallel with the outdoor unit (2) through the first communication pipe (11, 13) and the second communication pipe (12, 14) so that the air conditioner (1A) is switchable from a cooling operation into a heating operation and vice versa. On the other hand, FIG. 4 illustrates an air conditioner (1B) according to this embodiment which has been upgraded into a cooling/heating free type that can perform a cooling operation and a heating operation in parallel with each other. In these drawings, the reference numeral (7) denotes a structure such as a building. The reference numeral (7*a*) denotes the indoor space to be air-conditioned. The reference numeral (8) denotes an outdoor machine room. FIG. 5 illustrates, as a comparative example, an air conditioner (1C) according to a second embodiment to be described later. The air conditioner (1C) of the second embodiment is an air conditioner to be newly installed in its entirety.

The reinstallation method of this embodiment includes an operation switching unit connecting step to connect each operation switching unit (5) with its associated indoor unit (3) on an indoor unit basis, a gas-liquid separation unit connecting step to connect the gas-liquid separation unit (4) with the outdoor unit (2), and a pipe connecting step to connect the operation switching units (5) with the gas-liquid separation unit (4) in parallel with each other.

The operation switching unit connecting step is a step to connect each of the operation switching units (5), which changes the directions of a refrigerant flowing through its associated indoor unit (3) in response to a switch from a cooling operation to a heating operation, or vice versa, with the associated indoor unit (3) through two indoor communication pipes (13, 14) that form parts of the preinstalled communication piping.

The gas-liquid separation unit connecting step is a step to connect the gas-liquid separation unit (4), which is disposed separately from the operation switching units (5) in order to change the flow directions of a liquid refrigerant and a gas refrigerant, with the outdoor unit (2) through two outdoor communication pipes (11, 12) which form other parts of the preinstalled communication piping.

The pipe connecting step is a step to connect the operation switching units (5) with the gas-liquid separation unit (4) in parallel with each other through two intermediate communication pipes (15, 16) which form still other parts of the preinstalled communication piping, and one intermediate communication pipe (17) newly installed.

The first step of the reinstallation method of this embodiment may be either the operation switching unit connecting step or the gas-liquid separation unit connecting step. Optionally, the pipe connecting step may be either the second step or the last step.

—Operation—

Next, it will be described how the air conditioner (1) of this embodiment operates.

In this embodiment, a first heating dominant operation is conducted when the heating dominant operation is performed in the first load region shown in FIGS. 2A and 2B. A second heating dominant operation is conducted when the heating dominant operation is performed in the second load region. A first cooling dominant operation is conducted when the cooling dominant operation is performed in a region where the heating load is also processed. A second cooling dominant operation is conducted in the region where a full-cooling operation is performed.

In the following description, the three indoor units (3) shown in FIGS. 1 and 6-9 will be hereinafter referred to as, if necessary, a first indoor unit (3A), a second indoor unit (3B), and a third indoor unit (3C), respectively, from top to bottom. Likewise, the operation switching units (5) will also be hereinafter referred to as, if necessary, a first operation switching unit (5A), a second operation switching unit (5B), and a third operation switching unit (5C), respectively, from top to bottom.

〈First Heating Dominant Operation〉

The first heating dominant operation is an operation conducted in the first load region where the cooling load, out of the entire air conditioning load, is as low as from zero to approximately 20%. A full-heating operation will be described as an example of the first heating dominant operation with reference to FIG. 6.

In this case, in the outdoor unit (2), the three-way valve (24) is set to be the first position, the switching circuit (25) set to be the first position, and the solenoid valve (29) is closed. In the gas-liquid separation unit (4), the third intermediate motor operated valve (59*b*) is opened, and the first, second and fourth intermediate motor operated valves (58, 59*a*, 59*c*) are closed. In each of the operation switching units (5), the second switching valve (64) is opened and the first switching valve (63) is closed. In each of the indoor units (3), the indoor expansion valve (72) is opened.

When the compressor (21) is started, a high-pressure gas refrigerant discharged passes through the switching circuit (25) and then flows into the gas-liquid separation unit (4) through the second outdoor communication pipe (12). The high-pressure gas refrigerant passes through the gas-liquid separator (41) and flows into the respective operation switching units (5) through the third intermediate communication pipe (17). The high-pressure gas refrigerant further passes through the second indoor communication pipe (14) and flows into the respective indoor units (3). After having condensed in the indoor heat exchanger (71) to heat the indoor air, the refrigerant flows out of the indoor units (3), and passes through the first indoor communication pipe (13), the operation switching units (5), and the first intermediate communication pipe (15) to flow into the gas-liquid separation unit (4). The liquid refrigerant passes through the third intermediate motor operated valve (59*b*), the second connecting pipe (52), and the first outdoor communication pipe (11) to return to the outdoor unit (2). The liquid refrigerant flowed into the outdoor unit (2) is expanded in the second outdoor motor operated valve (36) of the switching circuit (25). Then, the liquid refrigerant evaporates in the outdoor heat exchanger (22) and is sucked into the compressor (21).

Such circulation of the refrigerants through the refrigerant circuit (20) allows all of the indoor units (3) to perform a heating operation.

In the example described above, the third intermediate motor operated valve (59*b*) is opened, and the refrigerant is expanded in the second outdoor motor operated valve (36) of the switching circuit (25). Alternatively, the refrigerant may be expanded in the third intermediate motor operated valve (59*b*), and the second outdoor motor operated valve (36) may be opened. Still alternatively, the refrigerant may also be expanded using both of these motor operated valves (59*b*, 36).

Figure 6:
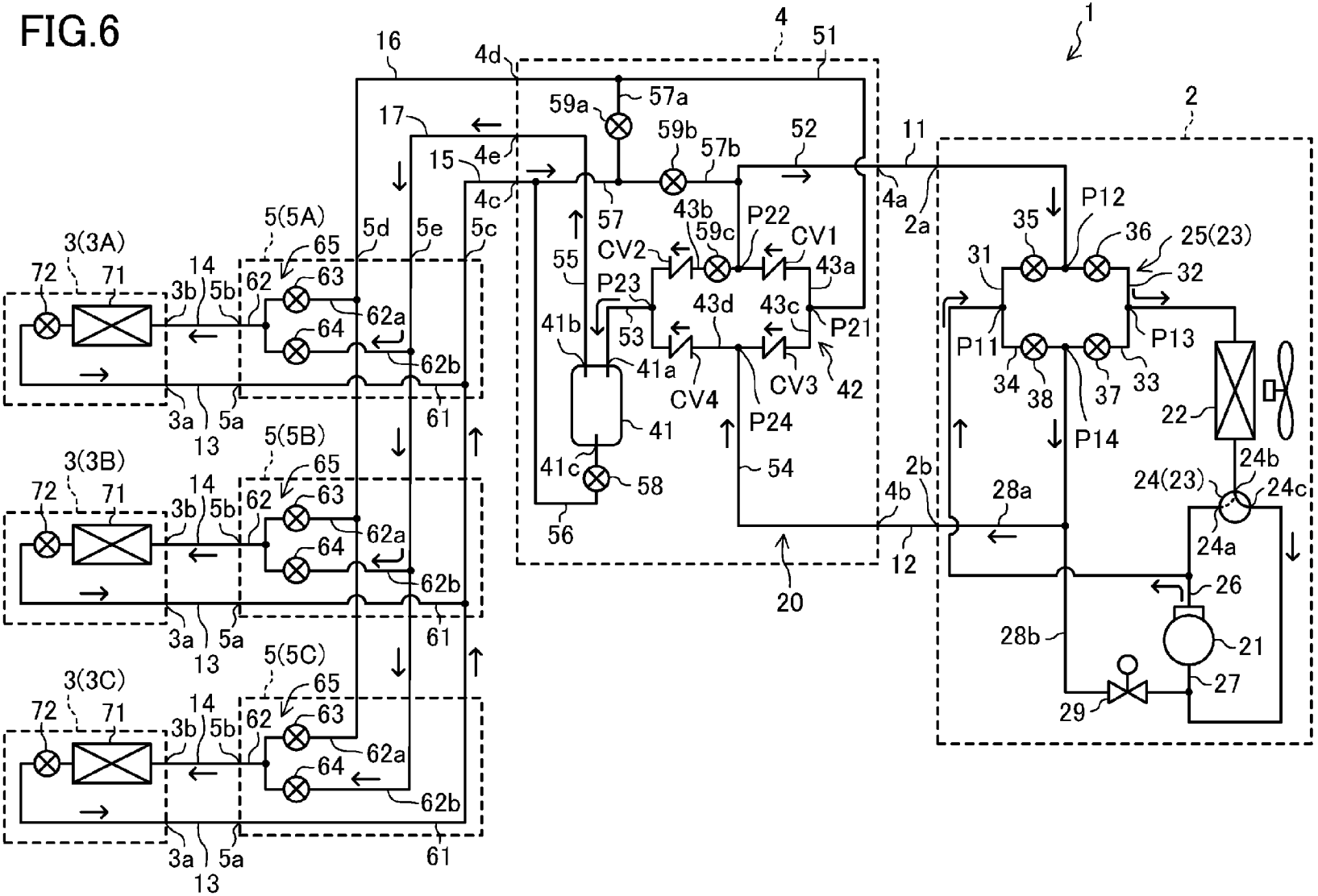
FIG. 6 illustrates the directions in which refrigerants flow through the refrigerant circuit of FIG. 1 during a first heating dominant operation.
Figure 7:
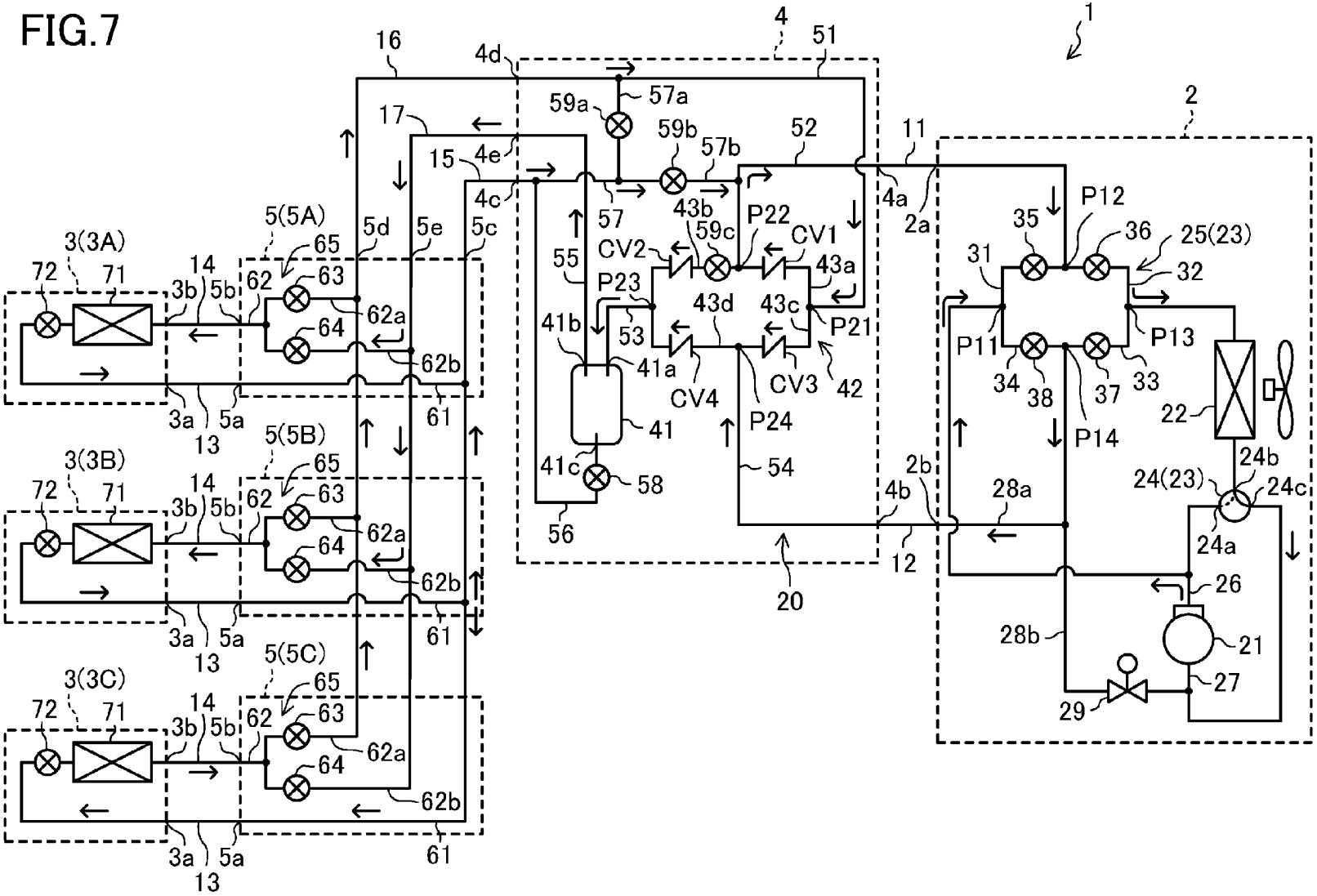
FIG. 7 illustrates the directions in which refrigerants flow through the refrigerant circuit of FIG. 1 during the first heating dominant operation where a cooling load is generated.

Although a full-heating operation has been described as an exemplary first heating dominant operation with reference to FIG. 6, the first heating dominant operation may also include a cooling operation performed by some of the plurality of indoor units (3) as illustrated in FIG. 7.

In this case, in the outdoor unit (2), the three-way valve (24) is set to be the first position, the switching circuit (25) is set to be the first position, and the solenoid valve (29) is closed. The second outdoor motor operated valve (36) is opened. In the gas-liquid separation unit (4), the third intermediate motor operated valve (59*b*) is adjusted to a predetermined degree of opening, and the first, second and fourth intermediate motor operated valves (58, 59*a*, 59*c*) are closed. In the first and second operation switching units (5A, 5B) performing a heating operation, the second switching valve (64) is opened and the first switching valve (63) is closed. In the third operation switching unit (5C) performing a cooling operation, the first switching valve (63) is opened and the second switching valve (64) is closed.

When the compressor (21) is started, a high-pressure gas refrigerant discharged passes through the switching circuit (25) and flows into the gas-liquid separation unit (4) through the second outdoor communication pipe (12). The high-pressure gas refrigerant passes through the gas-liquid separator (41) and flows into the first and second operation switching units (5A, 5B) through the third intermediate communication pipe (17). The high-pressure gas refrigerant further passes through the second indoor communication pipe (14) and flows into the first and second indoor units (3A, 3B). After having condensed in the indoor heat exchangers (71) to heat the indoor air, the refrigerants flow out of the first and second indoor units (3A, 3B) and pass through the first indoor communication pipes (13) and the first and second operation switching units (5A, 5B). Then, the refrigerants branch via the first intermediate communication pipe (15) into a refrigerant flowing into the gas-liquid separation unit (4) and a refrigerant flowing into the third operation switching unit (5C).

The refrigerant flows out of the third operation switching unit (5C) into the third indoor unit (3C) through the first indoor communication pipe (13), and evaporates in the indoor heat exchanger (71). Then, the refrigerant passes through the second indoor communication pipe (14) and the second intermediate communication pipe (16) to return to the gas-liquid separation unit (4).

The liquid refrigerant flowed out of the first intermediate communication pipe (15) into the gas-liquid separation unit (4) has its pressure reduced by the third intermediate motor operated valve (59*b*) to become a low-pressure two-phase refrigerant, which then flows into the second connecting pipe (52). The gas refrigerant flowed out of the second intermediate communication pipe (16) into the gas-liquid separation unit (4) passes through the first connecting pipe (51), the first connection point (P21), the passage (43*a*), and the second connection point (P22), and joins the low-pressure two-phase refrigerant in the second connecting pipe (52). The confluent refrigerant serves as a low-pressure two-phase refrigerant.

This low-pressure two-phase refrigerant passes through the first outdoor communication pipe (11) to return to the outdoor unit (2). After passing through the second outdoor motor operated valve (36) of the switching circuit (25), the low-pressure two-phase refrigerant evaporates in the outdoor heat exchanger (22) and is sucked into the compressor (21).

Such circulation of the refrigerants through the refrigerant circuit (20) allows most of the indoor units (3) to perform a heating operation and allows only some of them to perform a cooling operation.

〈Second Heating Dominant Operation〉

Figure 8:
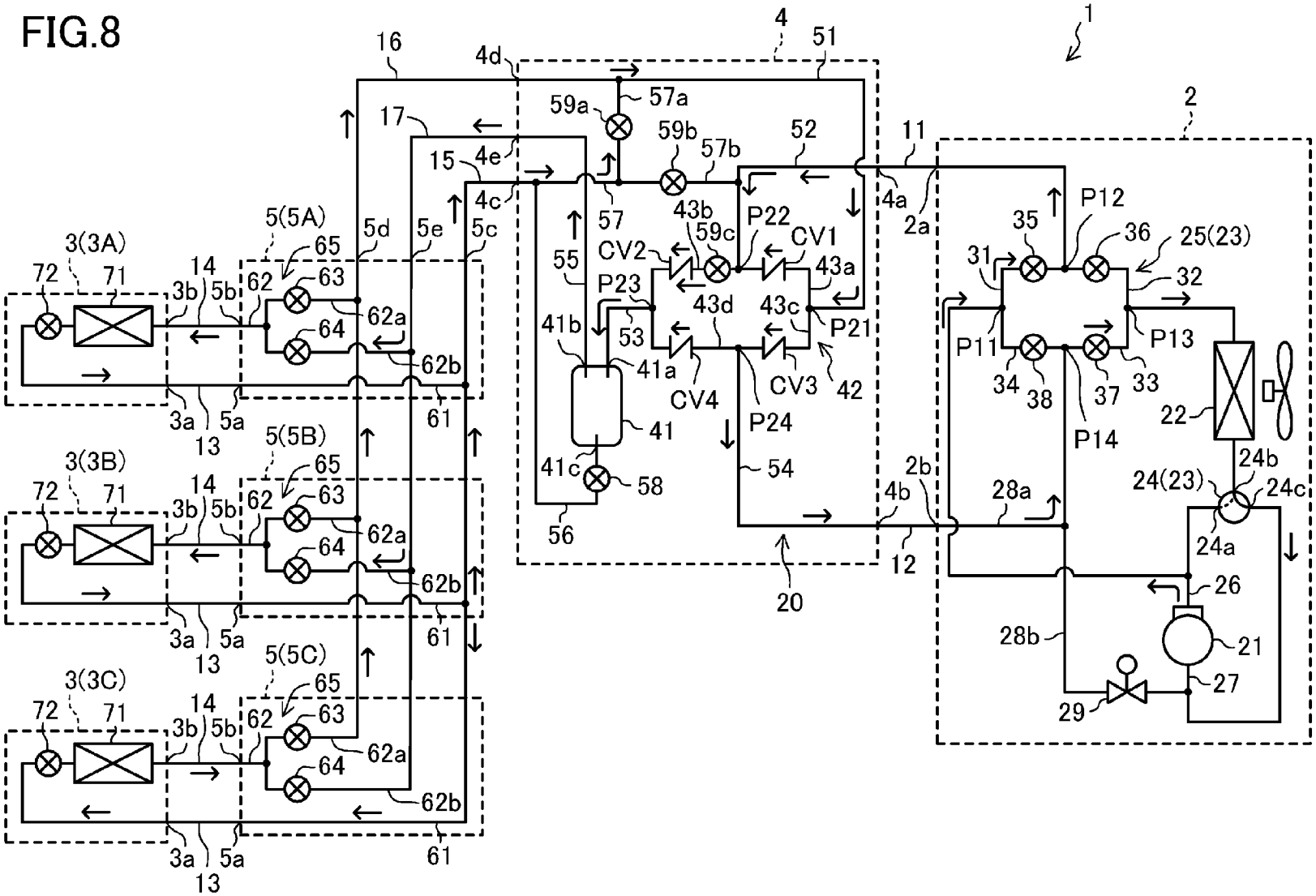
FIG. 8 illustrates the directions in which refrigerants flow through the refrigerant circuit of FIG. 1 during a second heating dominant operation.

The second heating dominant operation is an operation conducted in the second load region where the cooling load, out of the entire air conditioning load, is in the range of approximately 20% to 50%. In the following example, the first and second indoor units (3A, 3B) are supposed to perform a heating operation and the third indoor unit (3C) is supposed to perform a cooling operation as illustrated in FIG. 8.

In this case, in the outdoor unit (2), the three-way valve (24) is set to be the first position, the switching circuit (25) is set to be the second position, and the solenoid valve (29) is closed. In the gas-liquid separation unit (4), the second and fourth intermediate motor operated valves (59*a*, 59*c*) are opened, and the first and third intermediate motor operated valves (58, 59*b*) are closed. In the first and second operation switching units (5A, 5B), the first switching valve (63) is closed and the second switching valve (64) is opened. In the third operation switching unit (5C), the first switching valve (63) is opened and the second switching valve (64) is closed. In the first and second indoor units (3A, 3B), the indoor expansion valve (72) is opened. In the third indoor unit (3C), the indoor expansion valve (72) has its degree of opening adjusted.

In this state, the compressor (21) discharges a high-pressure gas refrigerant, which passes through the switching circuit (25) and flows into the gas-liquid separation unit (4) through the first outdoor communication pipe (11). The high-pressure gas refrigerant passes through the refrigerant flow channel switching circuit (42) and flows into the gas-liquid separator (41). The high-pressure gas refrigerant flows out of the gas refrigerant outlet (41*b*) of the gas-liquid separator (41) and passes through the third intermediate communication pipe (17) to flow into the respective operation switching units (5).

As described above, in the first and second operation switching units (5A, 5B), the second switching valve (64) is opened and the first switching valve (63) is closed. In the third operation switching unit (5C), the first switching valve (63) is opened and the second switching valve (64) is closed. This allows the refrigerants to flow from the first and second operation switching units (5A, 5B) into the first and second indoor units (3A, 3B) through the second indoor communication pipes (14). In the first and second indoor units (3A, 3B), the refrigerants condense and dissipate heat to heat the indoor air. The liquid refrigerants condensed return to the first and second operation switching units (5A, 5B). Some part of the liquid refrigerants condensed goes toward the third operation switching unit (5C), and another part of the liquid refrigerants condensed goes toward the gas-liquid separation unit (4).

The liquid refrigerant flowed into the third operation switching unit (5C) further passes through the first indoor communication pipe (13) to flow into the third indoor unit (3C) where the liquid refrigerant has its pressure reduced by the indoor expansion valve (72) to become a low-pressure two-phase refrigerant. This low-pressure two-phase refrigerant evaporates in the indoor heat exchanger (71) to become a gas refrigerant, and flows out of the third indoor unit (3C) into the third operation switching unit (5C) through the second indoor communication pipe (14). The gas refrigerant flowed into the third operation switching unit (5C) flows out of the first branch pipe (62*a*) into the gas-liquid separation unit (4) through the second intermediate communication pipe (16).

In the gas-liquid separation unit (4), the liquid refrigerant flowed in from the first and second operation switching units (5A, 5B) has its pressure reduced by the second intermediate motor operated valve (59*a*) to become a low-pressure two-phase refrigerant and confluent with a low-pressure gas refrigerant flowed in from the third operation switching unit (5C). The mixture of the low-pressure two-phase refrigerant and the low-pressure gas refrigerant is a low-pressure two-phase refrigerant, which returns from the refrigerant flow channel switching circuit (42) to the outdoor unit (2) through the second outdoor communication pipe (12). The low-pressure two-phase refrigerant returned to the outdoor unit (2) passes through the switching circuit (25) to flow into the outdoor heat exchanger (22) where the low-pressure two-phase refrigerant exchanges heat with the outdoor air and evaporates. The low-pressure gas refrigerant evaporated in the outdoor heat exchanger (22) passes through the three-way valve (24), and is sucked into the compressor (21).

Such circulation of the refrigerants through the refrigerant circuit (20) contributes to a refrigeration cycle in which the first and second indoor units (3A, 3B) perform a heating operation and the third indoor unit (3C) performs a cooling operation.

〈First Cooling Dominant Operation〉

Figure 9:
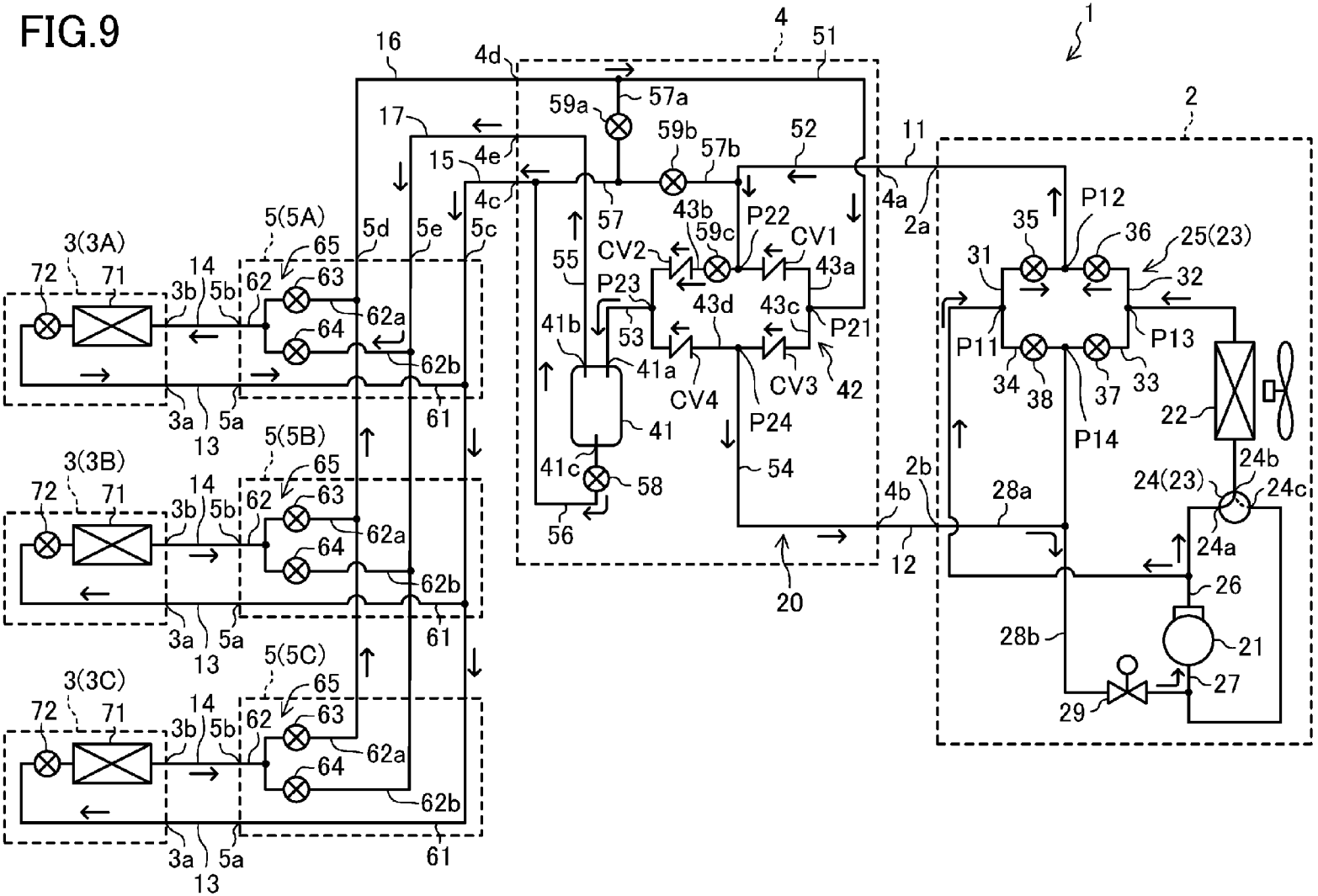
FIG. 9 illustrates the directions in which refrigerants flow through the refrigerant circuit of FIG. 1 during a first cooling dominant operation.

Next, a mode in which the first indoor unit (3A) performs a heating operation and the second and third indoor units (3B, 3C) perform a cooling operation will be described as a first cooling dominant operation with reference to FIG. 9.

In this case, in the outdoor unit (2), the three-way valve (24) is set to be the second position, and the first and second outdoor motor operated valves (35, 36) of the switching circuit (25) are opened, and the third and fourth outdoor motor operated valves (37, 38) thereof are closed. The solenoid valve (29) is opened. In the gas-liquid separation unit (4), the first and fourth intermediate motor operated valves (58) are opened, and the second and third intermediate motor operated valves (59*a*, 59*b*) are closed. In the first operation switching unit (5A), the first switching valve (63) is closed and the second switching valve (64) is opened. In the second and third operation switching units (5B, 5C), the first switching valve (63) is opened and the second switching valve (64) is closed. In the first indoor unit (3A), the indoor expansion valve (72) is opened. In the second and third indoor units (3B, 3C), the indoor expansion valve (72) has its degree of opening adjusted.

In this state, the compressor (21) discharges a high-pressure gas refrigerant, part of which passes through the three-way valve (24) to flow into the outdoor heat exchanger (22) where the high-pressure gas refrigerant condenses to become a liquid refrigerant to flow into the switching circuit (25). Another part of the high-pressure gas refrigerant discharged from the compressor (21) flows into the switching circuit (25) as a gas refrigerant. Then, the liquid refrigerant and the gas refrigerant are mixed in the switching circuit (25) to become a high-pressure two-phase refrigerant, which flows into the gas-liquid separation unit (4) through the first outdoor communication pipe (11).

The high-pressure two-phase refrigerant flowed into the gas-liquid separation unit (4) passes through the refrigerant flow channel switching circuit (42) to flow into the gas-liquid separator (41) where the high-pressure two-phase refrigerant is separated into a liquid refrigerant and a gas refrigerant. The gas refrigerant flows into the first operation switching unit (5A) through the third intermediate communication pipe (17) and then flows into the first indoor unit (3A) through the second indoor communication pipe (14). In the indoor heat exchanger (71) of the first indoor unit (3A), the refrigerant condenses and dissipates heat to heat the indoor air. The liquid refrigerant condensed in the indoor heat exchanger (71) of the first indoor unit (3A) is confluent with the liquid refrigerant discharged from the gas-liquid separator (41), and goes toward the second and third operation switching units (5B, 5C).

The liquid refrigerant flowed into the second and third operation switching units (5B, 5C) flows into the second and third indoor units (3B, 3C) through the first indoor communication pipe (13), and has its pressure reduced by the indoor expansion valve (72). Then, the liquid refrigerant evaporates in the indoor heat exchanger (71). In the meantime; the indoor air is cooled. The gas refrigerant passed through the indoor heat exchanger (71) passes through the second indoor communication pipe (14), the second and third operation switching units (5B, 5C), and the second intermediate communication pipe (16) to flow into the gas-liquid separation unit (4). This refrigerant passes through the refrigerant flow channel switching circuit (42) and the second outdoor communication pipe (12) of the gas-liquid separation unit (4) to return to the outdoor unit (2). Then, the refrigerant passes through the solenoid valve (29) and is sucked into the compressor (21).

Such circulation of the refrigerants through the refrigerant circuit (20) contributes to a refrigeration cycle in which the first indoor unit (3A) performs a heating operation and the second and third indoor units (3B, 3C) perform a cooling operation.

〈Second Cooling Dominant Operation〉

Figure 10:
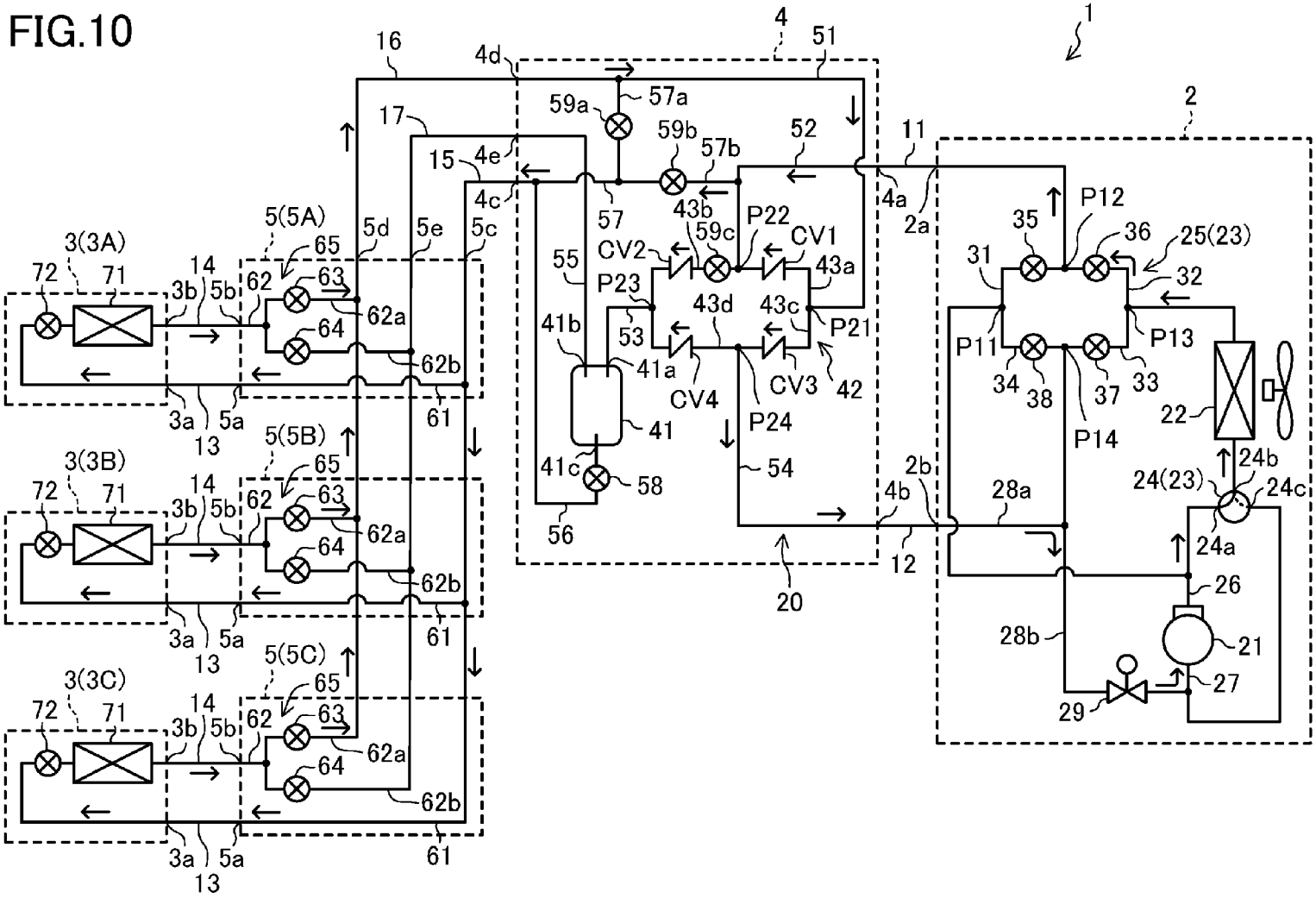
FIG. 10 illustrates the directions in which refrigerants flow through the refrigerant circuit of FIG. 1 during a second cooling dominant operation.

Next, the second cooling dominant operation, which is a full-cooling operation, will be described with reference to FIG. 10.

In this case, in the outdoor unit (2), the three-way valve (24) is set to be the second position, and the second outdoor motor operated valve (36) of the switching circuit (25) is opened, and the first, third and fourth outdoor motor operated valves (35, 37, 38) thereof are closed. The solenoid valve (29) is opened. In the gas-liquid separation unit (4), the third intermediate motor operated valve (59*b*) is opened, and the first, second and fourth intermediate motor operated valves (58, 59*a*, 59*c*) are closed. In the respective operation switching units (5), the first switching valve (63) is opened and the second switching valve (64) is closed. In the indoor units (3), the indoor expansion valve (72) has its degree of opening adjusted.

In this state, the compressor (21) discharges a high-pressure gas refrigerant, which passes through the three-way valve (24) to flow into the outdoor heat exchanger (22) where the high-pressure gas refrigerant condenses to become a liquid refrigerant. This high-pressure liquid refrigerant passes through the switching circuit (25), and then passes through the first outdoor communication pipe (11) to flow into the gas-liquid separation unit (4).

Since the fourth intermediate motor operated valve (59*c*) is closed, the high-pressure liquid refrigerant flowed into the gas-liquid separation unit (4) does not pass through the refrigerant flow channel switching circuit (42) and the gas-liquid separator (41), but passes through the third intermediate motor operated valve (59*b*) to flow out through the first intermediate communication pipe (15) into the respective operation switching units (5).

The high-pressure liquid refrigerant passes through the respective operation switching units (5), and flows into the respective indoor units (3) through the first indoor communication pipe (13). The high-pressure liquid refrigerant has its pressure reduced by the indoor expansion valve (72) of the indoor units (3), and evaporates in the indoor heat exchanger (71). The gas refrigerant evaporated in the indoor heat exchanger (71) passes through the second indoor communication pipe (14), the first branch pipe (62*a*) of the operation switching unit (5), and the second intermediate communication pipe (16) to flow into the gas-liquid separation unit (4). This low-pressure gas refrigerant passes through the refrigerant flow channel switching circuit (42) of the gas-liquid separation unit (4) and the second outdoor communication pipe (12) to return to the outdoor unit (2). The low-pressure gas refrigerant returned to the outdoor unit (2) passes through the solenoid valve (29) and is sucked into the compressor (21).

Such circulation of the refrigerants through the refrigerant circuit (20) contributes to a refrigeration cycle in which every indoor unit (3) performs a cooling operation.

—Advantages of First Embodiment—

According to this embodiment, when the heating dominant operation is performed in the second load region where the cooling load is relatively heavy, a high-pressure refrigerant (a high-pressure gas refrigerant) flows from the outdoor unit (2) into the indoor units (3) through the first outdoor communication pipe (11), and a low-pressure refrigerant (a low-pressure two-phase refrigerant) flows from the indoor units (3) into the outdoor unit (2) through the second outdoor communication pipe (12) thicker than the first outdoor communication pipe (11). This reduces the pressure loss of a refrigerant returning from the indoor units (3) to the outdoor unit (2) in the second load region, and thus reduces the deterioration in performance due to the pressure loss during the heating dominant operation.

Also, at the time of making a switch between the cooling dominant operation and the heating dominant operation, the direction of the refrigerants flowing through the first and second communication pipes (11, 12) does not change. This reliably reduces the pressure loss of a refrigerant returning from the indoor units (3) to the outdoor unit (2) when the heating dominant operation is performed in the second load region in which the cooling load is relatively heavy.

The pipe switching section (25) is implemented as a switching circuit, and the operation mode switching section (24) is implemented as a three-way valve. This can simplify the configuration of the air conditioner.

In addition, according to this embodiment, the refrigerant circuit (20) in which difluoromethane is used to keep the pressure relatively high during the operation reliably reduces a deterioration in the performance of the air conditioner due to the pressure loss.

《Second Embodiment of the Invention》

A second embodiment of the present invention will now be described.

Figure 11:
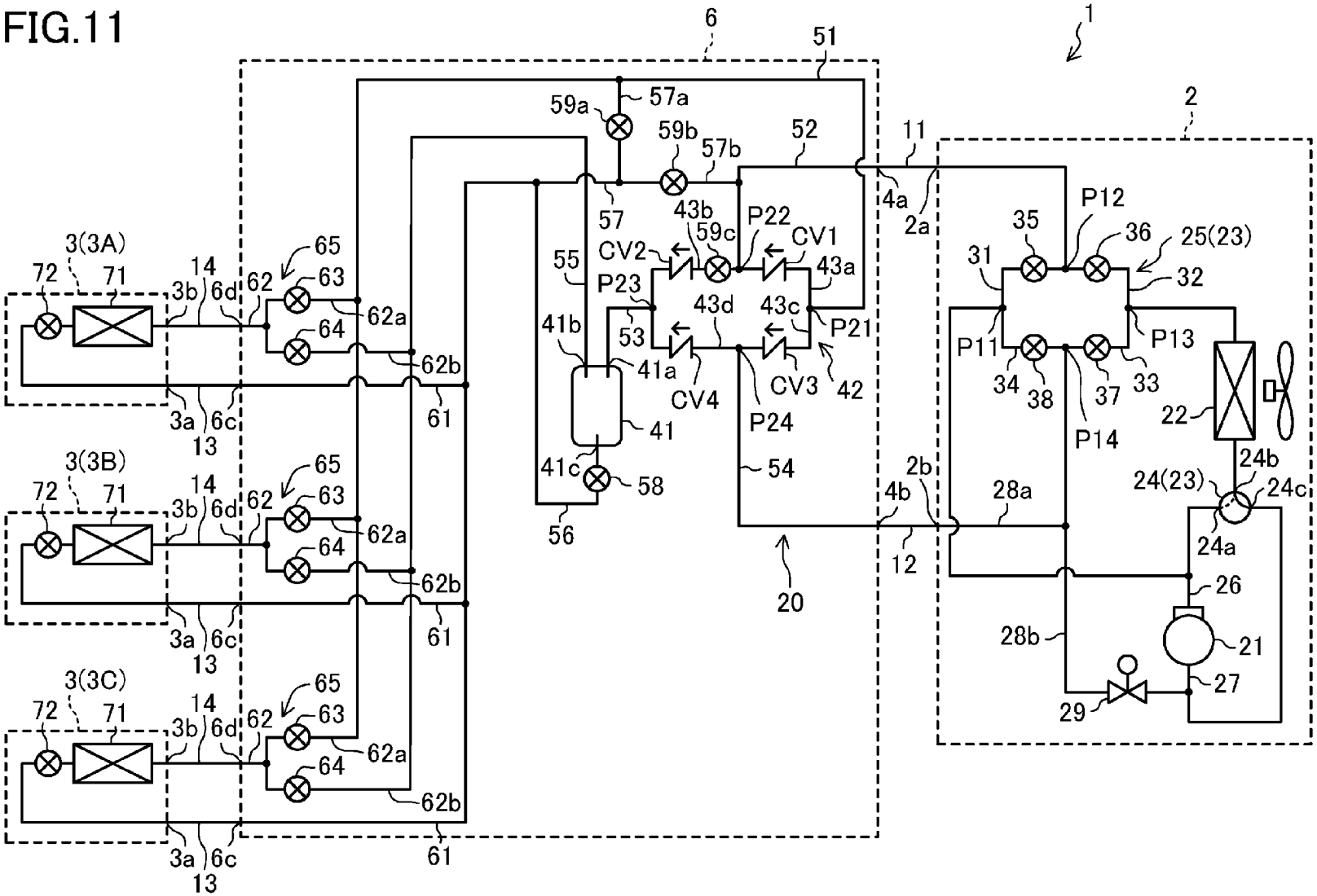
FIG. 11 is a diagram of a refrigerant circuit for an air conditioner according to a second embodiment of the present invention.

The second embodiment illustrated in FIG. 11 is an example in which the gas-liquid separation unit (4) and operation switching unit (5) of the first embodiment are integrated into a single cooling/heating switching unit (6).

The refrigerant circuit (20) has the same configuration as its counterpart of the first embodiment.

This cooling/heating switching unit (6) includes a first outdoor communication pipe port (4*a*), a second outdoor communication pipe port (4*b*), first indoor communication pipe ports (6*c*), and second indoor communication pipe ports (6*d*). The first, second, and third intermediate communication pipes (15, 16, 17) of the first embodiment are also replaced with intra-unit pipes.

Specifically, in this cooling/heating switching unit (6), a pipe of the refrigerant circuit (20), corresponding to the first intermediate communication pipe (15) of the first embodiment, is implemented as a pipe which is extended from a sixth connecting pipe (56) and connected to the first communication pipes (61). Also, another pipe of the refrigerant circuit (20), corresponding to the second intermediate communication pipe (16) of the first embodiment, is implemented as a pipe which is extended from the first connecting pipe (51) and connected to the first branch pipes (62*a*) of the second communication pipes (62). Furthermore, still another pipe of the refrigerant circuit (20), corresponding to the third intermediate communication pipe (17) of the first embodiment, is implemented as a pipe which is extended from the fifth connecting pipe (55) and connected to the second branch pipes (62*b*) of the second communication pipes (62).

In this embodiment, the cooling/heating switching unit (6) is a single compact unit and disposed in a machine room (7) outside of the living room as illustrated in FIG. 5. This cooling/heating switching unit (6) is connected with outdoor communication pipes (11, 12). The respective indoor units (3) are connected in parallel with the cooling/heating switching unit (6) through the respective indoor communication pipes (13, 14).

In the other respects, this second embodiment has the same configuration as the first embodiment. Thus, a specific description thereof is omitted. The operation of the second embodiment is also the same as that of the first embodiment.

As in the first embodiment, when the heating dominant operation is performed in the second load region where the cooling load is relatively heavy, a high-pressure refrigerant (a high-pressure gas refrigerant) flows from the outdoor unit (2) into the indoor units (3) through the first outdoor communication pipe (11), and a low-pressure refrigerant (a low-pressure two-phase refrigerant) flows from the indoor units (3) into the outdoor unit (2) through the second outdoor communication pipe (12) thicker than the first outdoor communication pipe (11). This reduces the pressure loss of a refrigerant returning from the indoor units (3) to the outdoor unit (2) in the second load region, and thus reduces the deterioration in performance due to the pressure loss during the heating dominant operation.

《Alternative Embodiments》

The embodiments described above may have the following configurations.

For example, although the switching circuit (25) of the embodiments described above is supposed to have four motor operated valves (35, 36, 37, 38), the switching circuit (25) may also have its configuration modified appropriately. Also, the three-way valve (24) used as an exemplary operation mode switching section in the embodiments described above may be replaced with any other appropriate switching mechanism.

The refrigerant circuit of the embodiments described above may have its configuration modified appropriately, too.

In summary, the present invention may use any other alternative configuration as long as a switching mechanism (23) is provided to change the directions of refrigerants flowing through the communication pipes (11, 12) depending on whether the heating dominant operation is being performed in the first load region where the cooling load is light or the second load region where the cooling load is heavier than in the first load region, in order to allow a low-pressure refrigerant to flow from the indoor units (3) to the outdoor unit (2) through the second communication pipe (12) thicker than the first communication pipe (11) in the second load region.

The above embodiments are merely preferred examples in nature, and are not intended to limit the scope of the present invention, applications thereof, or use thereof.

INDUSTRIAL APPLICABILITY

As can be seen from the foregoing description, the present invention is useful as an air conditioner that includes a plurality of indoor heat exchangers to perform a cooling operation and a heating operation in parallel with each other.

DESCRIPTION OF REFERENCE CHARACTERS

1 Air Conditioner
2 Outdoor Unit
3 Indoor Unit
11 First Outdoor Communication Pipe (First Communication Pipe)
12 Second Outdoor Communication Pipe (Second Communication Pipe)
13 First Indoor Communication Pipe
14 Second Indoor Communication Pipe
15 First Intermediate Communication Pipe
16 Second Intermediate Communication Pipe
17 Third Intermediate Communication Pipe
20 Refrigerant Circuit
21 Compressor
22 Outdoor Heat Exchanger
23 Opening/Closing Mechanism
24 Three-Way Valve (Operation Mode Switching Section)
25 Switching Circuit (Pipe Switching Section)
31 First Passage
32 Second Passage
33 Third Passage
34 Fourth Passage
35 First Outdoor Motor Operated Valve (Opening/Closing Mechanism)
36 Second Outdoor Motor Operated Valve (Opening/Closing Mechanism)
37 Third Outdoor Motor Operated Valve (Opening/Closing Mechanism)
38 Fourth Outdoor Motor Operated Valve (Opening/Closing Mechanism)
P11 First Connection Point
P12 Second Connection Point
P13 Third Connection Point
P14 Fourth Connection Point

The invention claimed is:

1. An air conditioner comprising:

a refrigerant circuit in which refrigerant flows through an outdoor unit, a gas-liquid separation unit, and a plurality of indoor units connected together through communication pipes and which is configured to be able to perform a refrigeration cycle in which cooling and heating operations are performed in parallel with each other, wherein the communication pipes include a first communication pipe connecting the outdoor unit and the gas-liquid separation unit and a second communication pipe which has a larger inside diameter than the first communication pipe connecting the outdoor unit and the gas-liquid separation unit such that refrigerant flows from the outdoor from to the gas-liquid separation unit and from the gas-liquid separation unit to the outdoor unit, the outdoor unit includes a compressor that compresses the refrigerant, an outdoor heat exchanger that exchanges heat between the refrigerant and outdoor air, and a switching mechanism which changes the directions of the refrigerants flowing through the first and second communication pipes depending on whether a heating dominant operation to be conducted between a full-heating load operation and a balanced heating and cooling load operation is being performed in a first load region which ranges from a full-heating load to a partial-cooling load or a second load region which ranges from the partial-cooling load to balanced heating and cooling loads, the switching mechanism includes a switching valve that switches communication states of a discharge-side pipe of a compressor and a suction-side pipe of the compressor to allow one of the discharge-side pipe and the suction-side pipe to communicate with a gas-side end of the outdoor heat exchanger, and a pipe switching section connected to the discharge-side pipe of the compressor, the first communication pipe, the second communication pipe, and a liquid-side end of the outdoor heat exchanger, in the first load region, the switching mechanism allows a high-pressure refrigerant to flow from the outdoor unit to the indoor units through the second communication pipe, and allows a low-pressure refrigerant to flow from the indoor units to the outdoor unit through the first communication pipe, and in the second load region, the switching mechanism allows the high-pressure refrigerant to flow from the outdoor unit to the indoor units through the first communication pipe, and allows the low-pressure refrigerant to flow from the indoor units to the outdoor unit through the second communication pipe.

2. The air conditioner of claim 1, wherein in all of the regions of the heating dominant operation, the switching mechanism is configured to perform a refrigeration cycle in which an outdoor heat exchanger in the outdoor unit serves as an evaporator.

3. The air conditioner of claim 2, wherein the pipe switching section switched between a first position and a second position, the pipe switching section in the first position allows the high-pressure refrigerant discharged from the compressor in the first load region to enter the second communication pipe, and allows the low-pressure refrigerant returning from the indoor units to the outdoor unit through the first communication pipe to enter the outdoor heat exchanger, and the pipe switching section in the second position allows the high-pressure refrigerant discharged from the compressor in the second load region to enter the first communication pipe, and allows the low-pressure refrigerant returning from the indoor units to the outdoor unit through the second communication pipe to enter the outdoor heat exchanger.

4. The air conditioner of claim 3, wherein the operation mode switching section switches between a first position where the heating dominant operation is conducted and a second position where the cooling dominant operation is conducted, the operation mode switching section in the first position allows the high-pressure refrigerant discharged from the compressor to enter the first communication pipe or the second communication pipe through the pipe switching section, and also allows the low-pressure refrigerant evaporated in the outdoor heat exchanger to enter the compressor, and the operation mode switching section in the second position allows the high-pressure refrigerant discharged from the compressor to enter the first communication pipe through the outdoor heat exchanger and the pipe switching section, and also allows the refrigerant returning to the outdoor unit through the second communication pipe to enter the compressor.

5. The air conditioner of claim 4, wherein the pipe switching section includes four connection points and four passages, the pipe switching section is implemented as a switching circuit in which the first and second connection points are connected together through the first passage, the second and third connection points are connected together through the second passage, the third and fourth connection points are connected together through the third passage, the fourth and first connection points are connected together through the fourth passage, and the passages of the switching circuit include opening/closing mechanisms, respectively.

6. The air conditioner of claim 5, wherein the first connection point of the pipe switching section is pipe-connected to the discharge-side pipe of the compressor, the second connection point is pipe-connected to the first communication pipe, the third connection point is pipe-connected to a liquid-side end of the outdoor heat exchanger, the fourth connection point is connected to the second communication pipe through a branch pipe and also connected to the suction-side pipe of the compressor through a branch pipe, and an on-off valve is provided for the branch pipe between the fourth connection point and the suction-side pipe of the compressor.

7. The air conditioner of claim 6, further comprising:

a plurality of operation switching units, each operation switching unit connected between the gas-liquid separation unit and a corresponding one of the indoor units, and including switching valves switching flows of a liquid refrigerant and a gas refrigerant in the corresponding indoor unit.

8. The air conditioner of claim 5, further comprising:

a plurality of operation switching units, each operation switching unit connected between the gas-liquid separation unit and a corresponding one of the indoor units, and including switching valves switching flows of a liquid refrigerant and a gas refrigerant in the corresponding indoor unit.

9. The air conditioner of claim 8, wherein the gas-liquid separation unit and the operation switching units are integrated together to form a single cooling/heating switching unit including the gas-liquid separator and the switching valves.

10. The air conditioner of claim 4, further comprising:

a plurality of operation switching units each operation switching unit connected between the gas-liquid separation unit and a corresponding one of the indoor units, and including switching valves switching flows of a liquid refrigerant and a gas refrigerant in the corresponding indoor unit.

11. The air conditioner of claim 10, wherein the gas-liquid separation unit and the operation switching units are integrated together to form a single cooling/heating switching unit including the gas-liquid separator and the switching valves.

12. The air conditioner of claim 3, further comprising:

a plurality of operation switching units, each operation switching unit connected between the gas-liquid separation unit and a corresponding one of the indoor units, and including switching valves switching flows of a liquid refrigerant and a gas refrigerant in the corresponding indoor unit.

13. The air conditioner of claim 12, wherein the gas-liquid separation unit and the operation switching units are integrated together to form a single cooling/heating switching unit including the gas-liquid separator and the switching valves.

14. The air conditioner of claim 2, further comprising:

a plurality of operation switching units, each operation switching unit connected between the gas-liquid separation unit and a corresponding one of the indoor units, and including switching valves switching flows of a liquid refrigerant and a gas refrigerant in the corresponding indoor unit.

15. The air conditioner of claim 14, wherein the gas-liquid separation unit and the operation switching units are integrated together to form a single cooling/heating switching unit including the gas-liquid separator and the switching valves.

16. The air conditioner of claim 1, further comprising:

a plurality of operation switching units, each operation switching unit connected between the gas-liquid separation unit and a corresponding one of the indoor units, and including switching valves switching flows of a liquid refrigerant and a gas refrigerant in the corresponding indoor unit.

17. The air conditioner of claim 16, wherein the gas-liquid separation unit and the operation switching units are integrated together to form a single cooling/heating switching unit including the gas-liquid separator and the switching valves.

18. The air conditioner of claim 1, wherein the refrigerant in the refrigerant circuit is difluoromethane.

19. A method for operating an air conditioner upgraded from an air conditioner, in which an outdoor unit and a plurality of indoor units are connected together through a first communication pipe and a second communication pipe, having a larger inside diameter than the first communication pipe, to allow a refrigerant circuit filled with a previous refrigerant to perform a cooling/heating switchable refrigeration cycle, into an air conditioner including a refrigerant circuit in which a new refrigerant, having a higher working pressure than the previous refrigerant, is used to perform a refrigeration cycle in which cooling and heating operations are performed in parallel with each other, wherein at the time of upgrading the air conditioner, installed is a switching mechanism which changes the direction of a refrigerant flowing through the first and second communication pipes depending on whether a heating dominant operation conducted between a full-heating load operation and a balanced heating and cooling load operation is being performed in a first load region ranging from a full-heating load to a partial-cooling load or a second load region ranging from the partial-cooling load to balanced heating and cooling loads, the air conditioner is operated such that the switching mechanism changes the directions of refrigerant flowing through the first and second communication pipes depending on whether the heating dominant operation to be conducted between the full-heating load operation and the balanced heating and cooling load operation is being performed in the first load region which ranges from the full-heating load to the partial-cooling load or the second load region which ranges from the partial-cooling load to balanced heating and cooling loads, in the first load region, the switching mechanism allows a high-pressure refrigerant to flow from the outdoor unit to the indoor units through the second communication pipe, and allows a low-pressure refrigerant to flow from the indoor units to the outdoor unit through the first communication pipe, and in the second load region, the switching mechanism allows a high-pressure refrigerant to flow from the outdoor unit to the indoor units through the first communication pipe, and allows a low-pressure refrigerant to flow from the indoor units to the outdoor unit through the second communication pipe.

20. The method of claim 19, further comprising:

operating the air conditioner, wherein the refrigerant in the refrigerant circuit of the upgraded air conditioner is difluoromethane.

* * * * *